United States Patent [19]

Ikematsu et al.

[11] Patent Number: 4,514,287

[45] Date of Patent: Apr. 30, 1985

[54] PROCESS FOR THE SOLVENT DEASPHALTING OF ASPHALTENE-CONTAINING HYDROCARBONS

[75] Inventors: Masaki Ikematsu; Isao Honzyo; Kazuo Sakai, all of Yokohama, Japan

[73] Assignee: Nippon Oil Co., Ltd., Tokyo, Japan

[21] Appl. No.: 454,831

[22] Filed: Dec. 30, 1982

[30] Foreign Application Priority Data

| | | | |
|---|---|---|---|
| Jan. 8, 1982 | [JP] | Japan | 57-999 |
| Apr. 2, 1982 | [JP] | Japan | 57-53695 |
| Apr. 2, 1982 | [JP] | Japan | 57-53696 |
| Apr. 2, 1982 | [JP] | Japan | 57-53933 |
| Apr. 2, 1982 | [JP] | Japan | 57-53934 |

[51] Int. Cl.[3] ..... C10G 21/06; C10G 25/00

[52] U.S. Cl. ..... 208/309; 208/293; 208/297

[58] Field of Search ..... 208/309, 293, 297

[56] References Cited

U.S. PATENT DOCUMENTS

| | | | |
|---|---|---|---|
| 2,587,643 | 3/1952 | Myers | 208/309 |
| 2,704,738 | 3/1955 | Simpson | 208/309 |
| 2,847,353 | 8/1958 | Beavon | 208/309 |
| 2,970,956 | 2/1961 | Shiah | 208/226 |
| 3,294,678 | 12/1966 | Gleim | 208/309 |
| 3,321,394 | 5/1967 | Mills | 208/45 |
| 3,414,506 | 12/1968 | Van Lookeren | 208/309 |
| 3,779,896 | 12/1973 | Woodle | 208/86 |
| 3,798,157 | 3/1974 | Manzanilla et al. | 208/251 R |
| 4,054,512 | 10/1977 | Dugan et al. | 208/309 |
| 4,363,717 | 12/1982 | Pelrine et al. | 208/108 |

*Primary Examiner*—Delbert E. Gantz
*Assistant Examiner*—O. Chaudhuri
*Attorney, Agent, or Firm*—Bucknam and Archer

[57] ABSTRACT

A process for the solvent deasphalting of asphaltene-containing hydrocarbons which comprising mixing asphaltene-containing hydrocarbons with a metal compound such as aluminum sulfate or titanium (IV) oxide and also with a solvent such as n-heptane, n-hexane, n-heptane or a mixed n-pentane.n-butanol solvent, to form a mixture which is then allowed to stand still to precipitate and separate the asphaltene therefrom thereby obtaining a deasphalted oil.

7 Claims, 3 Drawing Figures

PROCESS FOR THE SOLVENT DEASPHALTING OF ASPHALTENE-CONTAINING HYDROCARBONS

Figure 1:
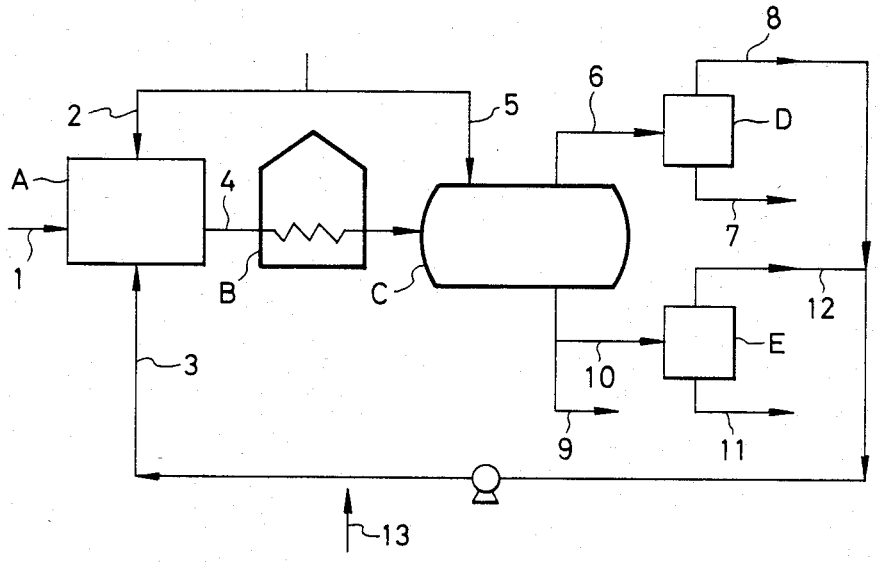

This invention relates to a process for the solvent deasphalting of asphaltene-containing hydrocarbons and more particularly it relates to an improved process for the solvent deasphalting of asphaltene-containing hydrocarbons which comprises adding a specific compound and a specific solvent to asphaltene-containing hydrocarbons to separate the asphaltene from said asphaltene-containing hydrocarbons.

Naturally occurring hydrocarbons generally contain a large proportion of aromatic ingredients and also contain a large amount of comparatively high molecular weight asphaltene containing compounds, in concentrated form, including various metal ingredients, sulphur, nitrogen and the like other than carbon and nitrogen. Such asphaltene as contained in the hydrocarbons is harmful in remarkably decreasing the catalytic activity due to the metal ingredients included in the asphaltene in the step of catalytic hydrogenation or catalytic cracking of heavy fraction oils for example. For this reason, when asphaltene-containing hydrocarbons are treated for their effective use, it is often necessary to remove the asphaltene which is a harmful ingredient.

A conventional method for the removal of the asphaltene from asphaltene-containing hydrocarbons is generally illustrated by a solvent deasphalting method comprising using low boiling paraffinic hydrocarbons including propane and butane to light naphtha in separating and removing the asphaltene from asphaltene-containing hydrocarbons.

This conventional solvent deasphalting method comprises deasphalting and solvent recovery. Formerly, the deasphalting was effected by a gravity precipitation system comprising mixing the asphaltene-containing hydrocarbons with a solvent and then introducing the resulting mixture into multiple-stage settlers to separate the asphaltene. However, this system is low in separation efficiency; thus, at present, the asphaltene-containing hydrocarbons are charged into an extraction tower (such as a baffle tower or rotary disc tower) at the top, while a solvent (such as propane, butane or pentane) is charged into the extraction tower at the portion near the bottom, and the hydrocarbons and solvent in the tower are heated to about 50°–200° C. under such a pressure that the solvent is prevented from evaporation at said temperature thereby to recover the deasphalted hydrocarbons with a part of the solvent from the tower at the top and the asphaltene with the remainder of the solvent therefrom at the bottom. This countercurrent extraction tower system is the most prevalently used and, further, similar systems of this type have been proposed and carried out. Furthermore, there are also known not only a forced separation system comprising mixing a heavy fraction oil with a solvent such as pentane or hexane, maintaining the resulting mixture at a suitable temperature and then separating the asphaltene from the oil, but also an electrostatic precipitation separation system comprising using a solvent mainly containing pentane in and applying an electric field to an asphaltene-containing oil in a settler so as to increase the precipitation velocity of the asphaltene for the separation thereof. The aforementioned various solvent deasphalting systems are described in, for example, "Kagaku Kogyo (Chemical Industry), No. 12, pages 31–40, 1976".

However, the countercurrent extraction tower system is disadvantageous in that it requires a large amount of a solvent, it does not exhibit a satisfactorily high yield of a deasphalted oil and it needs a large-scale extraction tower so that it is accompanied by problems as to its economy. Further, it needs a long treating time to separate asphaltene efficiently and also needs strict control of the flow rate, pressure and temperature of a starting oil to be deasphalted, this rendering the industrial operations complicated in many respects.

On the other hand, the forced separation system employing a hydrocyclone while it is effective in permitting the use of a miniaturized deasphalting apparatus, it needs a large-scale centrifuge to attain satisfactory separation efficiency so that it raises problems as to economy and it is not applicable in a case where the asphaltene to be separated is tacky so that the degree of refining of deasphalted oil to be obtained is limited. In addition, the electrostatic precipitation separation system needs application of high electric voltage thereby raising problems as to practicability.

As mentioned above, the conventional known methods for solvent deasphalting of asphaltene-containing hydrocarbons have raised various problems as to their economy.

Thus, the present inventors made various studies in attempts to eliminate the aforesaid disadvantages of the conventional methods and, as a result of their studies, they accomplished this invention.

An object of this invention is to provide a process for producing a desired deasphalted oil which is suitable for use as a starting oil in hydrolysis, fluidized catalytic cracking or the like and is obtained by removing harmful asphaltene, which has a high content of metals and causes problems as to decreased catalytic activity, coking and the like in the refining step, from asphaltene-containing hydrocarbons in a short treating time, at a low cost and with satisfactory selectivity by the use of simple operations.

The object of this invention may be achieved by a process comprising (I) mixing (A) 100 parts by weight of asphaltene-containing hydrocarbons with (B) 0.05–10 parts by weight of at least one metal compound selected from the group consisting of sulfates, sulfites, carbonates, halides, oxides, hydroxides, aliphatic monocarboxylates and aliphatic hydroxymonocarboxylates of magnesium, calcium, aluminum, iron and titanium as well as with (C) 50–2,000 parts by weight of at least one solvent selected from the group consisting of:

(1) aliphatic and alicyclic hydrocarbons having 3–20 carbon atoms, (2) saturated aliphatic and saturated alicyclic monohydric alcohols, (3) liquid hydrogen disulfide and (4) liquid carbon dioxide to form a mixture of the materials (A), (B) and (C) and then (II) allowing the thus formed mixture to stand still to precipitate and separate the asphaltene thus obtaining a deasphalted oil.

The process for solvent deasphalting asphaltene-containing hydrocarbons according to this invention will be explained in more detail hereunder.

The asphaltene-containing hydrocarbons used herein are various hydrocarbons containing usually 1–50 wt.%, preferably 3–30 wt.%, of asphaltene and they are exemplified by various oils obtained from oil shale, oil sand and tar sand, petroleum type crude oils, oils obtained by cracking said oils by any means, oils obtained by separating and removing a part or greater part of the light fraction from the aforementioned oils by means of distillation or the like, and mixtures thereof. Of these exemplified asphaltene-containing hydrocarbons, the preferred ones are a residual oil obtained atmospheric pressure distillation of a crude oil, a residual oil obtained by reduced pressure distillation and a residual oil obtained by cracking used in the step of refining of petroleum.

The metal compounds (B) used in this invention are generally in the solid form at ambient temperature (20° C.) and atmospheric pressure (1 atm.). They may be effectively used in this invention whether they are in the anhydrous or hydrate form. Thus, when they are represented by their chemical compound name or chemical formula, these name and formula are each intended to mean not only their anhydrous but also their hydrate(s) unless otherwise specified.

The preferable metal compounds (B) are enumerated as indicated below:

(a) magnesium compound selected from the sulfate, sulfite, carbonate, halides, oxide, hydroxide, aliphatic monocarboxylate and aliphatic hydroxymonocarboxylate of magnesium;
(b) calcium compound selected from the sulfate, sulfite, carbonate, halides, oxide, hydroxide, aliphatic monocarboxylate and aliphatic hydroxymonocarboxylate of calcium;
(c) aluminum compound selected from the sulfate, halides, oxide, hydroxide, aliphatic monocarboxylate and aliphatic hydroxymonocarboxylate of aluminum;
(d) iron compound selected from the sulfates, sulfites, carbonates, chlorides, oxides and hydroxides of iron;
(e) titanium compound selected from the sulfates, chlorides, oxides and hydroxides of titanium and
(f) mixtures of the compounds (a) to (e).

(B) (a) Magnesium sulfate used herein is represented by the chemical formula $MgSO_4$ which is generally referred to as Epsom salts. Magnesium sulfite, magnesium carbonate and magnesium hydroxide are represented by the chemical formulae $MgSO_3$, $MgCO_3$ and $Mg(OH)_2$, respectively. Magnesium oxide is MgO which is generally called magnesia. Magnesium halides are magnesium chloride ($MgCl_2$), magnesium bromide ($MgBr_2$), and magnesium iodide ($MgI_2$).

Magnesium aliphatic monocarboxylate or magnesium aliphatic hydroxymonocarboxylate used herein is a normal or basic salt of magnesium and aliphatic monocarboxylic acid or aliphatic hydroxymonocarboxylic acid, each acid having 4–30 carbon atoms.

The aliphatic monocarboxylic acids having 4–30 carbon atoms are a straight-chain or branched saturated aliphatic monocarboxylic acid or unsaturated aliphatic monocarboxylic acid represented by the general formula RCOOH wherein R is an alkyl or alkenyl group having 3–29 carbon atoms. Saturated aliphatic monocarboxylic acids having 4–30 carbon atoms include butanoic acid (butyric acid; $CH_3(CH_2)_2COOH$), 2-methylpropanoic acid (isobutyric acid; $(CH_3)_2CHCOOH$), pentanoic acid (valeric acid; $CH_3(CH_2)_3COOH$), 3-methylbutanoic acid (isovaleric acid; $(CH_3)_2CHCH_2COOH$), 2,2-dimethylpropanoic acid (trimethylacetic acid, pivalic acid; $(CH_3)_3CCOOH$), 2-methylbutanoic acid (methylethylacetic acid; $CH_3CH_2(CH_3)CHCOOH$), hexanoic acid (caproic acid; $CH_3(CH_2)_4COOH$), 4-methylpentanoic acid (isocaproic acid; $(CH_3)_2CH(CH_2)_2COOH$), 3-methylpentanoic acid (β-methylvaleric acid; $CH_3CH_2(CH_3)CHCH_2COOH$), 2-methylpentanoic acid (methyl-n-propylacetic acid; $CH_3(CH_2)_2CH(CH_3)COOH$), 3,3-dimethylbutanoic acid tert.-butylacetic acid; $(CH_3)_3CCH_2COOH$, 2,2-dimethylbutanoic acid (dimethylethylacetic acid; $C_2H_5C(CH_3)_2COOH$), 2,3-dimethylbutanoic acid (methylisopropylacetic acid; $(CH_3)_2CHCH(CH_3)COOH$), 2-ethylbutanoic acid (diethylacetic acid; $(C_2H_5)_2CHCOOH$), heptanoic acid (enanthic acid; $CH_3(CH_2)_5COOH$), octanoic acid (caprylic acid; $CH_3(CH_2)_6COOH$), 2,2,4-trimethylpentanoic acid ($(CH_3)_2CHCH_2(CH_3)_2CCOOH$), 2-ethylhexanoic acid ($CH_3(CH_2)_3CH(C_2H_5)COOH$), 2,2-diethylbutanoic acid (triethylacetic acid; $(C_2H_5)_3CCOOH)_{11}$, nonanoic acid (pelargonic acid; $CH_3(CH_2)_7COOH$), 2,6-dimethylheptanoic acid ($(CH_3)_2CH(CH_2)_3CH(CH_3)COOH$), decanoic acid (capric acid; $CH_3(CH_2)_8COOH$), undecanoic acid ($CH_3(CH_2)_9COOH$), 8-methyldecanoic acid ($(CH_3)_2CH(CH_2)_7COOH$), 2-methyldecanoic acid ($CH_3(CH_2)_7CH(CH_3)COOH$), dodecanoic acid (lauric acid; $CH_3(CH_2)_{10}COOH$), tridecanoic acid ($CH_3(CH_2)_{11}COOH$), tetradecanoic acid (myristic acid; $CH_3(CH_2)_{12}COOH$), hexadecanoic acid (palmitic acid; $CH_3(CH_2)_{14}COOH$), heptadecanoic acid (margaric acid; $CH_3(CH_2)_{15}COOH$), octadecanoic acid (stearic acid; $CH_3(CH_2)_{16}COOH$), eicosanoic acid (arachidic acid; $CH_3(CH_2)_{18}COOH$), docosanoic acid (behenic acid; $CH_3(CH_2)_{20}COOH$), tetracosanoic acid (lignoceric acid; $CH_3(CH_2)_{22}COOH$), hexacosanoic acid (cerotic acid; $CH_3(CH_2)_{24}COOH$), octacosanoic acid (montanic acid; $CH_3(CH_2)_{26}COOH$) and triacontanoic acid (melissic acid; $CH_3(CH_2)_{28}COOH$). On the other hand, the alkenyl group of the unsaturated aliphatic monocarboxylic acid may contain any number of unsaturated bonds, however, it contains preferably 1–3 and more preferably 1 unsaturated group.

The unsaturated aliphatic monocarboxylic acids include trans-2-butenoic acid (trans crotonic acid;

$$\overset{\text{trans}}{CH_3CH{=}{=}CHCOOH},$$

cis-2-butenoic acid (cis-crotonic acid;

$$\overset{\text{cis}}{CH_3CH{=}CHCOOH},$$

3-butenoic acid (vinylacetic acid; $CH_2{=}CHCH_2COOH$), 2-methylpropenoic acid (methacrylic acid; $CH_2{=}C(CH_3)COOH$), 2-pentenoic acid ($CH_3{-}CH_2CH{=}CHCOOH$), 2-methyl-cis-2-butenoic acid (angelic acid;

$$\overset{\text{cis}}{CH_3CH{=}C(CH_3)COOH},$$

2-methyl-trans-2-butenoic acid (tiglic acid;

$$\overset{\text{trans}}{CH_3CH{=}{=}C(CH_3)COOH},$$

3-methyl-2-butenoic acid (β-methylcrotonic acid; $(CH_3)_2C{=}CHCOOH$), 2-ethylpropenoic acid (α-ethylacrylic acid; $CH_2{=}CH(C_2H_5)COOH$), 3-pentenoic acid ($CH_3CH{=}CHCH_2COOH$), 4-pentenoic acid ($CH_2{=}CH(CH_2)_2COOH$), 2-hexenoic acid ($CH_3{-}(CH_2)_2CH{=}CHCOOH$), 2-methyl-2-pentenoic acid ($CH_3CH_2CH{=}C(CH_3)COOH$), 3-methyl-2-pentenoic acid ($CH_3CH_2(CH_3)C{=}CHCOOH$), 4-methyl-2-pentenoic acid (isopropylacrylic acid; $(CH_3)_2CHCH{=}CHCOOH$), 2-ethyl-2-butenoic acid (α-ethylcrotonic acid; $CH_3CH{=}C(C_2H_5)COOH$), 3-hexenoic acid (hydrosorbic acid; $CH_3CH_2CH{=}CHCH_2COOH$), 4-methyl-3-pentenoic acid ($(CH_3)_2C{=}CHCH_2COOH$), 2,2-dimethyl-3-butenoic acid ($CH_2{=}CHC(CH_3)_2COOH$), 4-hexenoic acid ($CH_3CH{=}CH(CH_2)_2COOH$), 5-hexenoic acid ($CH_2{=}CH(CH_2)_3COOH$), 2-heptenoic acid ($CH_3(CH_2)_3CH{=}CHCOOH$), 6-heptenoic acid ($CH_2{=}CH(CH_2)_4COOH$), 2-octenoic acid ($CH_3(CH_2)_4CH{=}CHCOOH$), 4-decenoic acid ($CH_3(CH_2)_4CH{=}CH(CH_2)_2COOH$), 9-decenoic acid ($CH_2{=}CH(CH_2)_7COOH$), 9-undecenoic acid ($CH_3CH{=}CH(CH_2)_7COOH$), 10-undecenoic acid ($CH_2{=}CH(CH_2)_8COOH$), 4-dodecenoic acid ($CH_3(CH_2)_6CH{=}CH(CH_2)_2COOH$), 5-dodecenoic acid ($CH_3(CH_2)_5CH{=}CH(CH_2)_3COOH$), 9-dodecenoic acid ($CH_3CH_2CH{=}CH(CH_2)_7COOH$), 4-tetradecenoic acid ($CH_3(CH_2)_8CH{=}CH(CH_2)_2COOH$), 9-tetradecenoic acid ($CH_3(CH_2)_3CH{=}CH(CH_2)_7COOH$), 9-hexadecenoic acid ($CH_3(CH_2)_5CH{=}CH(CH_2)_7COOH$), 2-octadecenoic acid (palmitoleic acid; $CH_3(CH_2)_{14}CH{=}CHCOOH$), 6-octadecenoic acid (petroselinic acid; $CH_3(CH_2)_{10}CH{=}CH(CH_2)_4COOH$), cis-9-octadecenoic acid (oleic acid;

$$\overset{\text{cis}}{CH_3(CH_2)_7CH{=}CH(CH_2)_7COOH},$$

trans-9-octadecenoic acid (elaidic acid;

$$\overset{\text{transe}}{CH_3(CH_2)_7CH{=}{=}CH(CH_2)_7COOH},$$

11-octadecenoic acid (vaccenic acid; $CH_3(CH_2)_5CH{=}CH(CH_2)_9COOH$), 12-octadecenoic acid; $CH_3(CH_2)_4CH{=}CH(CH_2)_{10}COOH$), 9-eicosenoic acid ($CH_3(CH_2)_9CH{=}CH(CH_2)_7COOH$), 11-eicosenoic acid ($CH_3(CH_2)_7CH{=}CH(CH_2)_9COOH$), 11-docosenoic acid ($CH_3(CH_2)_9CH{=}CH(CH_2)_9COOH$), cis-13-docosenoic acid (erucic acid;

$$\overset{\text{cis}}{CH_3(CH_2)_7CH{=}CH(CH_2)_{11}{-}COOH},$$

trans-13-docosenoic acid (brassidic acid;

$$\overset{\text{trans}}{CH_3(CH_2)_7CH{=}{=}CH(CH_2)_{11}COOH},$$

15-tetracosenoic acid ($CH_3(CH_2)_7CH{=}CH(CH_2)_{13}COOH$), 2,4,6-trimethyl-2-tetracosenoic acid (mycolipenic acid; $CH_3(CH_2)_{17}CH(CH_3)CH_2CH(CH_3)CH{=}C(CH_3)COOH$), 2,4-pentadienoic acid (β-vinylacrylic acid; $CH_2{=}CHCH{=}CHCOOH$), 2,4-hexadienoic acid (sorbic acid; $CH_3CH{=}CHCH{=}CHCOOH$), 2,7-dimethyl-2,6-octadienoic acid (geranic acid; $(CH_3)_2C{=}CHCH_2C(CH_3){=}CHCOOH$), 2,4-decadienoic acid ($CH_3(CH_2)_4CH{=}CHCH{=}CHCOOH$), 2,4-dodecadienoic acid ($CH_3(CH_2)_6CH{=}CHCOOH$), 9,12-hexadecadienoic acid ($CH_3(CH_2)_2CH{=}CHCH_2CH{=}CH(CH_2)_7COOH$), 9,12-octadecadienoic acid (linolic acid; $CH_3(CH_2)_4CH{=}CHCH_2CH{=}CH(CH_2)_7COOH$), 13,16-docosadienoic acid ($CH_3(CH_2)_4CH{=}CHCH_2CH{=}CH(CH_2)_{11}COOH$), 17,20-hexacodienoic acid ($CH_3(CH_2)_4CH{=}CHCH_2CH{=}CH(CH_2)_{15}COOH$), 11,14-eicosadienoic acid ($CH_3(CH_2)_{14}CH{=}CHCH_2CH{=}CH(CH_2)_9COOH$), 2,4,6-octatrienoic acid ($CH_3(CH{=}CH)_3COOH$), 3,7-dimethyl-2,4,6-octatrienoic acid (dehydrogeranic acid; $(CH_2)_2C{=}CHCH{=}CHC(CH_3){=}CHCOOH$), 9,11,13-octadecatrienoic acid (elaeostearic acid, punicic acid; $CH_3(CH_2)_3(CH{=}CH)_3(CH_2)_7COOH$), 9,12,15-octadecatrienoic acid (linolenic acid; $CH_3CH_2(CH{=}CHCH_2)_3(CH_2)_6COOH$), 6,9,12-octadecatrienoic acid ($CH_3(CH_2)_4(CH{=}CHCH_2)_3(CH_2)_3COOH$), 2,4,6,8-decatetraenoic acid ($CH_3(CH{=}CH)_4COOH$), 4,8,12,15-octadecatetraenoic acid ($CH_3CH_2CH{=}CHCH_2(CH{=}CHCH_2CH_2)_3COOH$), 5,8,11,14-eicosatetraenoic acid (arachidonic acid; $CH_3(CH_2)_4(CH{=}CHCH_2)_4(CH_2)_2COOH$), 4,8,12,15,19-docosapentaenoic acid ($CH_3(CH_2CH{=}CHCH_2)_2(CH{=}CHCH_2CH_2)_3COOH$) and 2,4,6,8,10,12,14-hexadecaheptaenoic acid ($CH_3(CH{=}CH)_7COOH$).

The aliphatic hydroxymonocarboxylic acids having 4–30 carbon atoms and used herein may be obtained by substituting one or more hydrogen atoms of the alkyl and alkenyl groups of the aliphatic monocarboxylic acids by hydroxyl group (OH). They may contain any number of hydroxyl groups (except for the hydroxyl group of the carboxyl groups), however, they contain preferably 1–3 hydroxyl groups and more preferably one hydroxyl group.

The aliphatic hydroxymonocarboxylic acids having 4–30 carbon atoms used herein include 2-hydroxybutanoic acid (α-hydroxy-n-butyric acid; $CH_3CH_2CH(OH)COOH$), 2-hydroxy-2-methylpropanoic acid (α-hydroxyisobutyric acid; $(CH_3)_2C(OH)COOH$), 2-hydroxypentanoic acid (α-hydroxy-n-valeric acid; $CH_3(CH_2)_2CH(OH)COOH$), 2-hydroxy-3-methylbutanoic acid (α-hydroxyisovaleric acid; $(CH_3)_2CHCH(OH)COOH$), 2-hydroxy-2-methylbutanoic acid ($CH_3CH_2C(CH_3)(OH)COOH$), 2-hydroxyhexanoic acid (α-hydroxy-n-caproic acid; $CH_3(CH_2)_3CH(OH)COOH$), 2-hydroxy-4-methylpentanoic acid (α-hydroxyisocaproic acid, leucic acid; $(CH_3)_2CHCH_2CH(OH)COOH$, 2-ethyl-2-hydroxybutanoic acid ($(C_2H_5)_2C(OH)COOH$), 2-hydroxy-3,3-dimethylbutanoic acid ($CH_3C(CH_3)_2CH(OH)COOH$), 2-hydroxy-2-methylpentanoic acid ($CH_3(CH_2)_2C(CH_3)(OH)COOH$), 2-hydroxy-5-methylhexanoic acid ($(CH_3)_2CH(CH_2)_2CH(OH)COOH$), 2-hydroxy-2,4-dimethylpentanoic acid ($(CH_3)_2CHCH_2C(CH_3)(OH)COOH$), 2-hydroxyhexadecanoic acid (α-hydroxypalmitic acid; $CH_3(CH_2)_{13}CH(OH)COOH$), 2-hydroxydocosanoic acid ($CH_3(CH_2)_{19}CH(OH)COOH$), 2-hydroxyhexacosanoic acid ($CH_3(CH_2)_{23}CH(OH)COOH$), 3-hydroxybutanoic acid (β-hydroxybutyric acid; $CH_3CH(OH)CH_2COOH$), 3-hydroxymethylpropanoic acid (β-hydroxyisobutyric acid; $HOCH_2CH(CH_3)COOH$), 3-hydroxypentanoic acid (β-hydroxy-n-valeric acid; $CH_3CH_2CH(OH)CH_2COOH$), 3-hydroxy-3-methylbutanoic acid (β-hydroxyisovaleric acid; $(CH_3)_2C(OH)CH_2COOH$), 3-hydroxy-2-ethylpropanoic acid (α-ethylhydroacrylic acid; $HOCH_2CH(C_2H_5)COOH$), 3-hydroxy-2,2-dimethylpropanoic acid (hydroxypivalic acid; $HOCH_2C(CH_2)_2COOH$), 3-hydroxy-2-methylpentanoic acid ($CH_3CH_2CH(OH)CH(CH_3)COOH$), hydroxyhexanoic acid ($CH_3(CH_2)_2CH(OH)CH_2COOH$), 3-hydroxyheptanoic acid ($CH_3(CH_2)_3CH(OH)CH_2COOH$), 3-hydroxyoctanoic acid ($CH_3(CH_2)_4CH(OH)CH_2COOH$), 3-hydroxynonanoic acid ($CH_3(CH_2)_5CH(OH)CH_2COOH$), 3-hydroxydecanoic acid ($CH_3(CH_2)_6CH(OH)CH_2COOH$), 3-hydroxyundecanoic acid ($CH_3(CH_2)_7CH(OH)CH_2COOH$), 3-hydroxydodecanoic acid ($CH_3(CH_2)_8CH(OH)CH_2COOH$), 11-hydroxytetradecanoic acid (convolvulinolic acid; $CH_3(CH_2)_2CH(OH)(CH_2)_9COOH$), 11-hydroxyhexadecanoic acid (jalatinolic acid; $CH_3(CH_2)_4CH(OH)(CH_2)_9COOH$), 14-hydroxyhexadecanoic acid ($CH_3CH_2CH(OH)(CH_2)_{12}COOH$), 12-hydroxydodecanoic acid (sabinic acid ω-hydroxylauric acid: $HOCH_2(CH_2)_{10}COOH$), 16-hydroxyhexadecanoic acid (juniperic acid, ω-hydroxypalmitic acid: $HOCH_2(CH_2)_{14}COOH$), 22-hydroxydocosanoic acid (phellonic acid; $HOCH_2(CH_2)_{20}COOH$), 2-hydroxy-3-butenoic acid (vinylglycollic acid; $CH_2{=}CHCH(OH)COOH$), 2-hydroxy-3-pentenoic acid (propenylglycollic acid; $CH_3CH{=}CHCH(OH)COOH$), 3-hydroxy-2-methylenebutanoic acid (plantenolic acid; $CH_3CH(OH)C(COOH){=}CH_2$), 12-hydroxy-cis-9-octadecenoic acid (ricinoleic acid;

$$CH_3(CH_2)_5CH(OH)CH_2CH\overset{cis}{=}CH(CH_2)_7COOH),$$

12-hydroxy-trans-9-octadecenoic acid (ricinelaidic acid;

$$CH_3(CH_2)_5CH(OH)CH_2CH\overset{trans}{=}CH(CH_2)_7COOH),$$

9-hydroxy-12-octadecenoic acid; ($CH_3(CH_2)_4CH{=}CH(CH_2)_4CH(OH)(CH_2)_7COOH$), 18-hydroxy-9,11,13-octadecanetrienoic acid (kamlolenic acid; $HOCH_2(CH_2)_3CH{=}CHCH{=}CHCH{=}CH(CH_2)_7COOH$), 2,3-dihydroxybutanoic acid (α,β-dihydroxybutyric acid; $CH_3CH(OH)CH(OH)COOH$), 2,3-dihydroxy-2-methylpropanoic acid (α,β-dihydroxyisobutyric acid, α-methylglyceric acid; $HOCH_2C(CH_3)(OH)COOH$), 3-hydroxy-2-hydroxymethylpropanoic acid (β,β'-dihydroxyisobutyric acid, bis(hydroxymethyl)acetic acid ($(HOCH_2)_2CHCOOH$), 3,4-dihydroxybutanoic acid (β,γ-dihydroxybutyric acid; $HOCH_2CH(OH)CH_2COOH$), 2,4-dihydroxy-3,3-dimethylbutanoic acid (α,γ-dihydroxy-β,β-dimethylbutyric acid; $HOCH_2C(CH_3)_2CH(OH)COOH$), 2,3-dihydroxy-2-(1'-methylethyl)butanoic acid (α,β-dihydroxy-α-isopropylbutyric acid, trachelantic acid, viridifloric acid; $CH_3CH(OH)C(OH)[CH(CH_3)_2]COOH$), 3,11-dihydroxytetradecanoic acid (ipurolic acid; $CH_3(CH_2)_2CH(OH)(CH_2)_7CH(OH)CH_2COOH$), 15,16-dihydroxyhexadecanoic acid (ustilic acid-A; $HOCH_2CH(OH)(CH_2)_{13}COOH$), 9,10-dihydroxyoctadecanoic acid ($CH_3(CH_2)_7CH(OH)CH(OH)(CH_2)_7COOH$), 2,3-dihydroxyoctanoic acid ($CH_3(CH_2)_4CH(OH)CH(OH)COOH$), 9,10-dihydroxyundecanoic acid ($CH_3CH(OH)CH(OH)(CH_2)_7COOH$), 9,10-dihydroxytetradecanoic acid ($CH_3(CH_2)_3CH(OH)CH(OH)(CH_2)_7COOH$), 9,10-dihydroxyhexadecanoic acid ($CH_3(CH_2)_5CH(OH)CH(OH)(CH_2)_7COOH$), 2,3-dihydroxyhexadecanoic acid ($CH_3(CH_2)_{12}CH(OH)CH(OH)COOH$), 6,7-dihydroxyhexadecanoic acid ($CH_3(CH_2)_8CH(OH)CH(OH)(CH_2)_4COOH$), 11,12-dihydroxyhexadecanoic acid ($CH_3(CH_2)_3CH(OH)CH(OH)(CH_2)_9COOH$), 9,10-dihydroxyeicosanoic acid ($CH_3(CH_2)_9CH(OH)CH(OH)(CH_2)_7COOH$), 11,12-dihydroxyeicosanoic acid ($CH_3(CH_2)_7CH(OH)CH(OH)(CH_2)_9COOH$), 13,14-dihydroxydocosanoic acid ($CH_3(CH_2)_7CH(OH)CH(OH)(CH_2)_{11}COOH$), 15,16-dihydroxytetracosanoic acid ($CH_3(CH_2)_7CH(OH)CH(OH)(CH_2)_{13}COOH$), 9,10-dihydroxy-10,12-octadecanedienoic acid ($CH_3(CH_2)_3CH(OH)CH{=}CHCH{=}CHCH(OH)(CH_2)_7COOH$), 12,13-dihydroxy-9-octadecenoic acid ($CH_3(CH_2)_4CH(OH)CH(OH)CH_2CH{=}CH(CH_2)_7COOH$), 2,3,4-trihydroxybutanoic acid (trihydroxybutyric acid; $HOCH_2CH(OH)CH(OH)COOH$), 2,3-dihydroxy-2-hydroxymethylpropanoic acid (trioxyisobutyric acid; $(HOCH_2)_2C(OH)COOH$), 3,4,5-trihydroxyhexanoic acid ($CH_3CH(OH)CH(OH)CH(OH)CH_2COOH$), 9,10,16-trihydroxyhexadecanoic acid (aleuritic acid; $HOCH_2(CH_2)_5CH(OH)CH(OH)(CH_2)_7COOH$), 2,15,16-trihydroyhexadecanoic acid (ustilic acid-B; $HOCH_2CH(OH)(CH_2)_{12}CH(OH)COOH$), 9,10,12-trihydroxyoctadecanoic acid (trihydroxystearic acid; $CH_3(CH_2)_5CH(OH)CH_2CH(OH)CH(OH)(CH_2)_7COOH$), 9,10,18-trihydroxyoctadecanoic acid (phloionolic acid; $HOCH_2(CH_2)_7CH(OH)CH(OH)(CH_2)_7COOH$) and 9,10,12,13-tetrahydroxyoctadecanoic acid ($CH_3(CH_2)_4CH(OH)CH(OH)CH_2CH(OH)CH(OH)(CH_2)_7COOH$).

The magnesium salts of aliphatic monocarboxylic acids or aliphatic hydroxymonocarboxylic acids according to this invention may be a normal or basic salt of magnesium and such an aliphatic monocarboxylic or hydroxymonocarboxylic acid as mentioned above. The aliphatic monocarboxylic or hydroxymonocarboxylic acids used herein contain preferably 5–24 carbon atoms and more preferably 6–18 carbon atoms.

The aforesaid normal salt is represented by the general formula $(R'COO)_2Mg$ wherein R'COO is the residue of the aliphatic monocarboxylic acid or the aliphatic hydroxymonocarboxylic acid, and the basic salt is represented by the general formula $(R'COO)_nMg(OH)_{2-n}$ wherein R'COO is the residue of the aliphatic monocarboxylic acid or the aliphatic hydroxymonocarboxylic acid and n is $0<n<2$.

(B)(b) The calcium compounds include calcium sulfate ($CaSO_4$), calcium sulfite ($CaSO_3$), calcium carbonate ($CaCO_3$), calcium halides ($CaCl_2$, $CaBr_2$ and $CaI_2$), calcium oxide (CaO) which is generally called quick lime, and calcium hydroxide ($Ca(OH_2)$) which is generally called slaked lime.

The calcium salts of aliphatic monocarboxylic or hydroxymonocarboxylic acids according to this invention may be a normal or basic salt of calcium and an aliphatic monocarboxylic or hydroxymonocarboxylic acid having 4–30 carbon atoms. The aliphatic monocarboxylic acids having 4–30 carbon atoms are the same as those previously mentioned in connection with the magnesium compounds. The aliphatic hydroxymonocarboxylic acids having 4–30 carbon atoms used herein are also the same as those previously mentioned in connection with the magnesium compounds.

It is desirable to use a normal or basic salt of calcium and the aliphatic monocarboxylic or hydroxymonocarboxylic acid having preferably 5–24 carbon atoms and more preferably 6–18 carbon atoms.

The normal calcium salt is represented by the general formula $(R'COO)_2Ca$ wherein R'COO is the residue of said aliphatic monocarboxylic acid or said aliphatic hydroxymonocarboxylic acid, and the basic calcium salt is represented by the general formula $(R'COO)_n$-$Ca(OH)_{2-n}$ wherein R'COO is the residue of said aliphatic monocarboxylic acid or said aliphatic hydroxymonocarboxylic acid and n is $0<n<2$.

(B)(c) The aluminum compounds include aluminum sulfate ($Al_2(SO_4)_3$) which is generally called alum earth, basic aluminum sulfate ($Al_2(OH)_{6-n}(SO_4)_{\frac{1}{2}n}$ wherein n is $0<n<6$) which is generally called alumina white, aluminum halides such as aluminum chloride ($AlCl_3$), polyaluminum chloride, aluminum bromide ($AlBr_3$) and aluminum iodide ($AlI_3$), aluminum oxide (alumina, $Al_2O_3$, and alumina gel) and aluminum hydroxide ($Al(OH)_3$).

The aluminum salts of aliphatic monocarboxylic or hydroxymonocarboxylic acids may be a normal or basic salt of aluminum and the aliphatic monocarboxylic or hydroxymonocarboxylic acid having 4–30 carbon atoms. The aliphatic monocarboxylic or hydroxymonocarboxylic acids having 4–30 carbon atoms are the same as those previously mentioned in connection with the magnesium compounds. It is desirable, however, to use the aliphatic monocarboxylic or hydroxymonocarboxylic acids having preferably 5–24 carbon atoms and more preferably 6–18 carbon atoms.

The normal aluminum salt is represented by the general formula $(R'COO)_3Al$ wherein R'COO is the residue of the aliphatic monocarboxylic acid or the aliphatic hydroxymonocarboxylic acid, and the basic aluminum salt is represented by the general formula $(R'COO)_nAl(OH)_{3-n}$ wherein R'COO is the residue of the aliphatic monocarboxylic acid or the aliphatic hydroxymonocarboxylic acid and n is $0<n<3$.

(B)(d) The sulfates of iron used herein are intended to mean not only iron sulfate but also basic iron sulfate, and more particularly the iron sulfate is iron(II) sulfate (ferrous sulfate; $FeSO_4$), iron(II) iron(III) sulfate (ferrousferric sulfate; $FeSO_4.Fe_2(SO_4)_3$) or iron(III) sulfate (ferric sulfate; $Fe_2(SO_4)_3$). The basic iron sulfate is generally called iron(III) hydroxysulfate and is a compound represented by the general formula $aFe_2O_3.bSO_3.cH_2O$ ($a>0$, $b\geqq 0$, $c\geqq 0$). Typical of the basic iron sulfates are compounds represented by $2Fe_2O_3.5SO_3$, $Fe_2O_3.2SO_3$, $2Fe_2O_3.3SO_3$, $3Fe_2O_3.4SO_3$, $Fe_2O_3.SO_3$ and $2Fe_2O_3.SO_3$ and are also hydrates of these compounds.

The sulfites of iron used herein are iron sulfite and basic iron sulfite, and more particularly the iron sulfite is iron(II) sulfite (ferrous sulfite; $FeSO_3$) or iron(III) oxysulfite (ferric oxysulfite, basic ferric sulfite; $Fe_2O_3(SO_3)$). The carbonates of iron used herein is iron carbonate and more particularly it is iron(II) carbonate (ferrous carbonate; $FeCO_3$). The chlorides of iron are iron chloride and basic iron chloride, and more particularly the iron chloride is iron(II) chloride (ferrous chloride; $FeCl_2$), iron(III) chloride (ferric chloride; $FeCl_3$) or iron(II) iron(III) chloride (ferric ferrous chloride; $Fe_3Cl_7$ and $Fe_3Cl_8$). The basic iron chloride is generally called iron oxychloride and more particularly it is iron(III) oxychloride (ferric oxychloride; FeOCl). The oxides of iron used herein are iron oxides and more particularly they are iron(II) oxide (ferrous oxide; FeO), iron(III) oxide (ferric oxide; $Fe_2O_3$) and iron(II) iron(III) oxide (ferrosoferric oxide; $Fe_3O_4$). The hydroxides of iron are iron hydroxides and more particularly they are iron(II) hydroxide (ferrous hydroxide; $Fe(OH)_2$), iron(III) hydroxide (ferric hydroxide, iron(III) oxyhydroxide, iron(III) oxide hydrate; FeO(OH) or $Fe_2O_3.nH_2O$ wherein n is more than zero ($n<0$)) and iron(II) iron(III) hydroxide (ferrosoferric hydroxide, iron(II) iron(III) oxide hydrate; $Fe_3O_4.nH_2O$ wherein n is more than zero ($n>0$).

(B)(e) The sulfates of titanium used herein is titanium sulfate and basic titanium sulfate. More particularly the titanium sulfate is titanium(III) sulfate (titanous sulfate; $Ti_2(SO_4)_3$) or titanium(IV) sulfate (titanic sulfate; $Ti(SO_4)_2$). The basic titanium sulfate is titanium oxysulfate (titanyl sulphate; $TiOSO_4$) or titanium oxytrisulfate ($Ti_2O(SO_4)_3$). The chlorides of titanium is titanium chloride or basic titanium chloride, and more particularly the titanium chloride is titanium(II) chloride (titanium dichloride; $TiCl_2$) or titanium(III) chloride (titanium trichloride; $TiCl_3$). The basic titanium chloride is generally called titanium oxychloride and more particularly it is titanium(IV) oxychloride ($TiCl_3OH$, $TiCl_2(OH)_2$, $TiCl(OH)_3$). The oxides of titanium are titanium oxides and more particularly they are titanium(II) oxide (titanium monoxide; TiO), titanium(III) oxide (dititanium trioxide, titanium sesquioxide; $Ti_2O_3$), titanium(IV) oxide (titanium dioxide, titania; $TiO_2$) and titanium peroxide ($TiO_3$). They also include $\beta$-titanic acid (metatitanic acid; $TiO_2.H_2O \equiv H_2TiO_3$). The hydroxides of titanium are titanium hydroxides and more particularly they are titanium(III) hydroxide (titanium trihydroxide; $Ti(OH)_3$) and titanium(IV) hydroxide (titanium tetrahydroxide, $\alpha$-titanic acid, orthotitanic acid; $Ti(OH)_4 = H_4TiO_4$).

The metal compound (B) used in this invention also includes a metal compound containing at least two members selected from the foregoing enumerated magnesium, calcium, aluminum, iron and titanium compounds and further includes a metal compound containing at least one member selected from said enumerated metal compounds and at least one member selected from magnesium, calcium, aluminum, iron and titanium compounds other than said enumerated metal compounds; such metal compounds are illustrated by double salts, basic salts, double oxides and double hydroxides. More specifically, these metal compounds include magnesium hydroxycarbonate (basic magnesium carbonate; $3MgCO_3.MgOH_2$), calcium magnesium carbonate ($CaCO_3.MgCO_3$), bleaching powder ($CaCl_2.Ca(OCl)_2$), magnesium aluminum oxide (magnesium aluminate; $MgO.Al_2O_3$), calcium aluminate ($CaO.Al_2O_3$, $3CaO.Al_2O_3$, $CaO.2Al_2O_3$, etc.), magnesium ferrite (magnesium iron oxide; $MgO.Fe_2O_3$), calcium titanium sulphate (calcium trisulfatotitanate(IV); $CaSO_4.Ti(SO_4)_2$), magnesium metatitanate ($MgO.TiO_2$), calcium metatitanate ($CaO.TiO_2$), iron(II) metatitanate (ferrous metatitanate; $FeO.TiO_2$), iron(II) orthotitanate (ferrous orthotitanate; $2FeO.TiO_2$) and iron(III) titanium oxide (ferric titanium oxide; $Fe_2O_3.TiO_2$, $Fe_2O_3.3TiO_2$, $2Fe_2O_3.3TiO_2$).

The metal compounds (B) according to this invention further include metal compounds containing both at least one member selected from all the metal compounds so far mentioned, and at least one member selected from the sulfate, carbonate and halides of ammonium, the sulfates, carbonates, halides and oxides of alkali metals (Li, Na, K, Rb, Cs) and the oxides of divalent metals (Be, Mn(II), Co(II), Ni(II), Zn, Sr, Cd(II), Ba and Pd(II); the metal compounds so further included are double salts, double oxides, double hydroxides and the like.

The metal compounds so further included are exemplified by ammonium magnesium sulfate ($(NH_4)_2SO_4.MgSO_4$), sodium magnesium sulfate ($Na_2SO_4.MgSO_4$, $3Na_2SO_4.MgSO_4$), potassium magnesium sulfate ($K_2SO_4.MgSO_4$, $K_2SO_4.2MgSO_4$), rubidium magnesium sulfate ($Rb_2SO_4.MgSO_4$, $Rb_2SO_4.2MgSO_4$), cesium magnesium sulfate ($Cs_2SO_4.MgSO_4$), ammonium magnesium carbonate ($(NH_4)_2CO_3.MgCO_3$), ammonium magnesium chloride ($NH_4Cl.MgCl_2$), sodium magnesium chloride ($NaCl.MgCl_2$, 2NaCl.MgCl), potassium magnesium chloride ($KCl.MgCl_2$, $2KCl.MgCl_2$), sodium calcium sulfate ($Na_2SO_4.CaSO_4$, $3Na_2SO_4.CaSO_4$, $4Na_2SO_4.CaSO_4$), potassium calcium sulfate ($K_2SO_4.CaSO_4$, $K_2SO_4.2CaSO_4$, $K_2SO_4.5CaSO_4$), potassium calcium magnesium sulfate ($K_2SO_4.2CaSO_4.MgSO_4$, $K_2SO_4.4CaSO_4.MgSO_4$), potassium calcium chloride ($KCl.CaCl_2$), ammonium aluminum sulfate ($(NH_4)_2SO_4.Al_2(SO_4)_3$), lithium aluminum sulfate ($Li_2SO_4.Al_2(SO_4)_3$), sodium aluminum sulfate ($Na_2SO_4.Al_2(SO_4)_3$), potassium aluminum sulfate ($K_2SO_4.Al_2(SO_4)_3$), rubidium aluminum sulfate ($Rb_2SO_4.Al_2(SO_4)_3$), cesium aluminum sulfate ($Cs_2SO_4.Al_2(SO_4)_3$), ammonium aluminum chloride ($NH_4Cl.AlCl_3$), sodium aluminum chloride ($NaCl.AlCl_3$), lithium metaaluminate ($Li_2O.Al_2O_3$), sodium aluminate ($3Na_2O.Al_2O_3$, $Na_2O.Al_2O_3$), potassium metaaluminate ($K_2O.Al_2O_3$), aluminum beryllate (beryllium aluminum oxide; $Al_2O_3.3BeO$), cobalt(II) aluminum oxide (cobalt(II) aluminate; $CoO.Al_2O_3$, $4CoO.3Al_2O_3$), zinc aluminum oxide ($ZnO.Al_2O_3$), strontium aluminate ($3SrO.Al_2O_3$), barium aluminate ($3BaO.Al_2O_3$), ammonium iron(II) sulphate (ammonium ferrous sulphate; $(NH_4)_2SO_4.FeSO_4$), ammonium iron(III) sulphate (ammonium ferric sulfate; $(NH_4)_2SO_4.Fe(SO_4)_3$), triammmonium iron(III) trisulfate (triammonium ferric trisulfate; $3(NH_4)_2SO_4Fe_2(SO_4)_3$, potassium iron(II) sulfate (potassium ferrous sulfate; $K_2SO_4.FeSO_4$), potassium iron(III) sulfate (potassium ferric sulfate; $K_2SO_4.Fe_2(SO_4)_3$), rubidium iron(II) sulfate (rubidium ferrous sulfate; $Rb_2SO_4.FeSO_4$), rubidium iron(III) sulfate (rubidium ferric sulfate; $Rb_2SO_4.Fe_2(SO_4)_3$, cesium iron(II) sulfate (cesium ferrous sulfate; $Cs_2SO_4.FeSO_4$), cesium iron(III) sulphate (cesium ferric sulfate; $Cs_2SO_4.Fe_2(SO_4)_3$), potassium iron(II) carbonate (potassium iron(II) dicarbonatoferrate; $K_2CO_3.FeCO_3$), potassium iron(II) chloride (potassium ferrous chloride; $KCl.FeCl_2$, $2KCl.FeCl_2$), potassium iron(III) chloride (potassium ferric chloride, potassium pentachloroferrate(III); $2KCl.FeCl_3$), potassium sodium iron(II) chloride (potassium sodium ferrous chloride; $3KCl.NaCl.FeCl_2$), lithium ferrite (lithium iron(III) oxide; $Li_2O.Fe_2O_3$), sodium ferrite ($Na_2O.Fe_2O_3$, $3Na_2O.Fe_2O_3$, $3Na_2O.5Fe_2O_3$), sodium octahydroxoferrate(III) ($5Na_2O.Fe_2O_3.8H_2O$), sodium heptahydroxoaquoferrate(III) ($4Na_2O.Fe_2O_3.8H_2O$), potassium ferrite ($K_2O.Fe_2O_3$, $K_2O.2Fe_2O_3$, $K_2O.7Fe_2O_3$), barium ferrite ($BaO.Fe_2O_3$, $BaO.2Fe_2O_3$, $BaO.3Fe_2O_3$, $BaO.4Fe_2O_3$, $2BaO.3Fe_2O_3$), zinc ferrite (zinc iron (III) oxide; $ZnO.Fe_2O_3$, $2ZnO.Fe_2O_3$, $4ZnO.Fe_2O_3$), lead iron(III) oxide (lead ferrite; $PbO.Fe_2O_3$), lead iron(III) iron(II) oxide (lead iron(II) ferrite; $PbO.FeO.4Fe_2O_3$), ammonium titanium sulfate ($(NH_4)_2SO_4.3Ti_2(SO_4)_3$), sodium titanium sulfate (sodium trisulfatotitanate(IV); $Na_2SO_4.Ti(SO_4)_2$), potassium titanium sulfate (potassium trisulfatotitanate(IV); $K_2SO_4.Ti(SO_4)_2$), strontium titanium sulfate (strontium trisulfatotitanate(IV); $SrSO_4.Ti(SO_4)_2$), sodium orthotitanate ($2Na_2O.TiO_2$), sodium metatitanate ($Na_2O.TiO_2$), potassium metatitanate ($K_2O.TiO_2$), dipotassium dititanate ($K_2O.2TiO_2$), manganese(II) titanium oxide ($MnO.TiO_2$), cobalt(II) titanium oxide (cobaltous titanium oxide, cobaltous titanate; $CoO.TiO_2$), nickel(II) titanium oxide ($NiO.TiO_2$), strontium metatitanate ($SrO.TiO_2$), cadmium(II) titanium oxide ($CdO.TiO_2$), barium orthotitanate ($2BaO.TiO_2$), barium metatitanate ($BaO.TiO_2$) and lead(II) titanium oxide ($PbO.TiO_2$).

The metal compounds (B) still further include naturally occurring and synthetic ones as well as mixtures thereof. The naturally occurring metal compounds used herein include kieserite ($MgSO_4.H_2O$), magnesite ($MgCO_3$), bischofite ($MgCl_2.6H_2O$), periclase ($MgO$), brucipe ($Mg(OH)_2$), hydromagnesite ($3MgCO_3.Mg(OH)_2.3H_2O$), bloedite ($Na_2SO_4.MgSO_4.4H_2O$), lehiite ($Na_2SO_4.MgSO_4.2,5H_2O$), vanthoffite ($3Na_2SO_4.MgSO_4$), picromerite ($K_2SO_4.MgSO_4.6H_2O$), leonite ($K_2SO_4.MgSO_4.4H_2O$), langbeinite ($K_2SO_4.2MgSO_4$), kainite ($KCl.MgSO_4.3H_2O$), carnallite ($KCl.MgCl_2.6H_2O$), anhydrite (anhydrous gypsum; $CaSO_4$), gypsum ($CaSO_4.2H_2O$), calcite ($CaCO_3$), aragonite ($CaCO_3$), limestone ($CaCO_3$), dolomite ($CaCO_3.MgCO_3$), glauberite ($Na_2SO_4.CaSO_4$), syngenite ($K_2SO_4.CaSO_4.H_2O$), polyhalite ($K_2SO_4.2CaSO_4.MgSO_4.2H_2O$), krugite ($K_2SO_4.4CaSO_4.MgSO_4.2H_2O$), diaspore ($Al_2O_3.H_2O$), boehmite ($Al_2O_3.H_2O$), gibbsite ($Al_2O_3.3H_2O$), hydrargillite ($Al_2O_3.3H_2O$), ammonium alum ($NH_4Al(SO_4)_2.12H_2O=\frac{1}{2}[(NH_4)_2SO_4.Al_2(SO_4)_3.24H_2O]$), sodium alum ($NaAl(SO_4)_2.12H_2O=\frac{1}{2}[Na_2SO_4.Al_2(SO_4)_3.24H_2O]$), potassium alum ($KAl(SO_4)_2.12H_2O=\frac{1}{2}[K_2SO_4.Al_2(SO_4)_3.24H_2O]$), brownmillerite ($4CaO.Al_2O_3.Fe_2O_3$), chrysoberyl ($BeO.Al_2O_3$), gahnite (zinc spinel; $ZnO.Al_2O_3$), iron spinel ($FeO.Al_2O_3$), spinel ($MgO.Al_2O_3$), galaxite ($MnO.Al_2O_3$), szomolnokite ($FeSO_4.H_2O$), melanterite ($FeSO_4.7H_2O$), roemerite ($FeSO_4.Fe_2(SO_4)_3.2\sim15H_2O$), bilinite ($FeSO_4.Fe_2(SO_4)_3.24H_2O$), kornelite ($Fe_2(SO_4)_3.7.5H_2O$), coquimbite ($Fe_2(SO_4)_3.9H_2O$), quenstedtite ($Fe_2(SO_4)_3.10H_2O$), amarantite ($Fe_2O_3.2SO_3.7H_2O$), castanite ($Fe_2O_3.2SO_3.8H_2O$), carphosiderite ($3Fe_2O_3.4SO_3.9H_2O$), utahite ($Fe_2O_3.SO_3.4/3\sim2H_2O$), glockerite ($2Fe_2O_3.SO_3.6H_2O$), hydroglockerite ($Fe_2O_3.SO_3.8H_2O$), siderite ($FeCO_3$), wuestite ($FeO$), hematite ($Fe_2O_3$), magnetite ($Fe_3O_4$), goethite ($FeO(OH)$), lepidocrosite ($FeO(OH)$), breunerite ($(Mg,Fe)CO_3$ type solid solution), magnesioferrite ($MgO.Fe_2O_3$), rinneite ($3KCl.NaCl.FeCl_3$), jarosite ($K_2O.3Fe_2O_3.4SO_3.6H_2O$), magnetoplumbite ($PbO.6Fe_2O_3$), brookite ($TiO_2$), octahedrite ($TiO_2$), rutile ($TiO_2$), perovskite ($CaO.TiO_2$), ilmenite ($FeO.TiO_2$), titanomagnetite ($Fe_2O_3.TiO_2$), arizonite ($Fe_2O_3.3TiO_2$) and pseudobrookite ($2Fe_2O_3.3TiO_2$).

The various metal compounds (B) so far described may preferably be used alone or in combination, among which are more preferred magnesium sulfate, magnesium carbonate, magnesium chloride, magnesium oxide, magnesium hydroxide, magnesium hydroxycarbonate, calcium sulfate, calcium carbonate, calcium chloride, calcium oxide, calcium hydroxide, calcium magnesium carbonate, aluminum sulfate, aluminum chloride, polyaluminum chloride, aluminum oxide, aluminum hydroxide, basic aluminum sulfate, potassium alum, ammonium alum, calcium aluminate, sodium aluminate, alumina gel, iron(III) sulfate, basic iron sulfate (iron(III) hydroxysulfate), iron(II) sulfite, iron(II) carbonate, iron(II) chloride, iron(III) chloride, iron(III) oxychloride, iron(II) oxide, iron(III) oxide, iron(II) hydroxide, iron(III) hydroxide, iron(II)(III) hydroxide, magnesium ferrite, titanium(III) sulfate, titanium(IV) sulfate, titanium oxysulfate, titanium oxytrisulfate, titanium(III) chloride, titanium(II) oxide, titanium(III) oxide, titanium(IV) oxide, titanium(III) hydroxide, titanium(IV) hydroxide, calcium titanium sulfate, magnesium metatitanate, calcium metatitanate, iron(II) metatitanate, iron(II) orthotitanate and iron(III) titanium oxide.

The further preferred of the metal compounds (B) so far mentioned are calcium sulfate, calcium carbonate, calcium chloride, calcium oxide, magnesium sulfate, magnesium oxide, magnesium hydroxide, aluminum sulfate, aluminum chloride, polyaluminum chloride, aluminum oxide, basic aluminum sulfate, sodium aluminate, alumina gel, iron(III) sulphate, iron(II) oxide, iron(III) oxide, iron(III) hydroxide, magnesium ferrite, titanium(IV) sulfate, titanium(III) oxide, titanium(IV) oxide, titanium(IV) hydroxide, calcium titanium sulfate, magnesium metatitanate, calcium metatitanate, iron(II) metatitanate, iron(II) orthotitanate, iron(III) titanium oxide and mixtures thereof.

The metal compounds (B) used in this invention may be used in any form, however, it is desirable to use them in the form of granules or powder having a particle size of preferably 0.1μ–3.0 mm, more preferably 1μ–1.0 mm and most preferably 1μ–500μ. In a case where such granules or powder is classified into primary particles and secondary particles (these secondary particles being produced by the primary particles being bonded together), said particle sizes indicate those of the secondary particles.

The solvent (C) used in this invention is at least one member selected from (1) aliphatic or alicyclic hydrocarbons having 3–20 carbon atoms, preferably 3–8 carbon atoms, (2) saturated aliphatic or saturated alicyclic monohydric alcohols having 1–10 carbon atoms, preferably 1–5 carbon atoms, (3) liquid hydrogen sulfide and (4) liquid carbon dioxide.

The aliphatic or alicyclic hydrocarbons (C)(1) may be a saturated or unsaturated hydrocarbon, and the aliphatic hydrocarbons may be a straight-chain or branched hydrocarbon. The saturated aliphatic hydrocarbons used herein include, for example, propane, n-butane, methylpropane, n-pentane, methylbutane, ethylpropane, n-hexane, n-heptane, n-octane, n-nonane, n-decane, 2,3-diethylhexane, 2,3,5-trimethylheptane, n-dodecane, 3-ethyl-5-butyloctane, n-pentadecane, 3-butyl-6-methyldecane, n-octadecane and n-nonadecane. The saturated alicyclic hydrocarbons include, for example, cyclopentane, cyclohexane, decalin, 2-methyldecalin, heptylcyclohexane, octylcyclohexane and dodecylcyclopentane. The unsaturated aliphatic hydrocarbons include, for example, 1-butene, 1-pentene, 1-hexene, 2-methyl-1-pentene, 1-heptene, 3-ethyl-1-pentene, 1-octene, 3-methyl-1-octene and 1-decene. The unsaturated alicyclic hydrocarbons include, for example, cyclopentene, cyclohexene, 2-methylcyclohexene, 2-ethylcyclopentene, 2-propylcyclopentene, 2-butylcyclopentene and octahydronaphthalene.

The solvents (C)(1) are illustrated by the aforesaid hydrocarbons and mixtures thereof, and the preferred ones are propane, n-butane, n-heptane, n-hexane, n-heptane, cyclopentane, cyclohexane, cyclopentene, cyclohexene, 2-methylcyclohexene and mixtures thereof.

The solvents (C)(1) used herein also include LPG fractions, light gasoline fractions, heavy gasoline fractions and kerosene fractions, each obtained by the distillation of crude oils at atmospheric pressure, these fractions being each a mixture of the above-mentioned various hydrocarbons.

The saturated aliphatic and alicyclic monohydric alcohols (C)(2) include, for example, methanol, ethanol, n-propanol, isopropanol, n-butanol, n-pentanol, n-hexanol, n-heptanol, n-octanol, cyclopentanol, cyclohexanol and mixtures thereof with n-propanol, isopropanol, n-butanol, n-pentanol and mixtures thereof being preferred.

The solvents (C) which are at least one member selected from the above-mentioned hydrocarbons (1) and alcohols (2) as well as liquid hydrogen disulfide (3) and liquid carbon dioxide, may be pure or may contain a small amount of impurities such as water. They may be used alone or in combination. The solvents which may preferably be used alone include propane, n-butane, n-pentane, n-hexane, n-heptane, n-propanol, isopropanol and n-butanol. The solvents which may preferably be used in combination are a mixture of a saturated aliphatic hydrocarbon selected from propane, n-butane and n-pentane with a saturated aliphatic monohydric alcohol selected from n-propanol, isopropanol and n-butanol, with a mixture of n-pentane with n-butanol being especially preferred.

The amount of the metal compound (B) added to the asphaltene-containing hydrocarbon (A) in this invention is 0.05–10 parts and preferably 0.1–5 parts by weight per 100 parts by weight of the hydrocarbon (A). It is one of the features of this invention to enable the asphaltene to be removed from the asphaltene-containing hydrocarbons efficiently in a sufficiently short time only by adding such a small amount of the metal compound to the asphaltene-containing hydrocarbons.

On the other hand, the amount of the solvent (C) added to the asphaltene-containing hydrocarbons is 50–2,000, preferably 100–1,000 and more preferably 200–800 parts by weight per 100 parts by weight of the asphaltene-containing hydrocarbons.

According to this invention, the asphaltene-containing hydrocarbons (A) are mixed with the metal compound (B) and the solvent (C) to rapidly precipitate and remove the asphaltene from the hydrocarbons (A). It is preferable to allow the resulting mixture to stand still until it has been separated industrially and easily into the substantially asphaltene-free hydrocarbons (hereinafter referred to as "deasphalted oil") and the asphaltene precipitated and removed.

In the practice of this invention, separation systems of any conventional type may be used without need of designing and constructing new systems for solvent deasphalting. This invention may be carried out by the use of a conventionally-used extraction type, forced separation type or like type solvent deasphalting system thereby to obtain, as compared with conventional systems, remarkable effects such as the improvement of asphaltene removal efficiency and the shortening of time needed for the separation. In a case where this invention is practiced by the use of a solvent deasphalting system using countercurrent extraction tower, there are obtained effects such as the prevention of flooding which may otherwise be caused in, for example, the baffle tower, rotary disc tower in the extraction type system and the reduction of amount of a solvent used as compared with the conventional systems. Further, in a case where this invention is carried out by the use of a forced separation type solvent deasphalting system, there is effective in greatly reducing the load of the forced separator used.

As is mentioned above, this invention may be easily carried out with excellent effects being obtained even by the use of the conventional solvent deasphalting system. It is desirable, however, to use a simple system without such countercurrent extraction towers, forced separators and the like in order to make the best use of the advantages of this invention. Therefore, the most preferable system for carrying out this invention is a gravity precipitation type solvent deasphalting system in which the separation of asphaltene is effected only by settlers. It will be impossible to effect precipitation separation of asphaltene by allowing asphaltene-containing hydrocarbons to stand still if the conventional systems are used; for this reason, the conventional systems need the countercurrent extraction towers, cyclones and forced separators such as centrifuges. In contrast, this invention enables such precipitation separation of asphaltene to be easily effected since the asphaltene is rapidly precipitated for its separation from asphaltene-containing hydrocarbons according to this invention. According to this invention, wholesale installations such as countercurrent extraction towers and forced separators, can be dispensed with to effect a process for the solvent deasphalting of asphaltene-containing hydrocarbons, whereby the process is greatly enhanced in economy.

In this invention, the metal compounds (B) and the solvent (C) may be added to the asphaltene-containing hydrocarbons in any order and in any way. It is possible to add the metal compound to the hydrocarbons and then add the solvent thereto by means of line mixing or the like, however, it is preferable from the view-point of separation efficiency to add the metal compound and the solvent at the same time to the hydrocarbons or to add the solvent and then the metal compound to the hydrocarbons. In a case where the metal compound and the solvent are attempted to be added at the same time to the hydrocarbons, these metal compound and solvent may be added through their respective lines to the hydrocarbons or may be mixed together for subsequent addition of the resulting mixture to the hydrocarbons. Further, the metal compound may be added in two portions, one portion being added together with the solvent and the other being added downstream of the line to promote precipitation of the asphaltene.

In a case where this invention is carried out by a gravity precipitation type solvent deasphalting process, it is preferable that either the asphaltene-containing hydrocarbons, metal compound and solvent are mixed together on a mixer to form a mixture or the metal compound is mixed firstly with the solvent and secondly with the hydrocarbons to form a mixture and then the thus formed mixture is introduced into settlers where it is allowed to stand still for precipitation separation of the asphaltene from the mixture. It is also preferable that the asphaltene-containing hydrocarbons and the solvent are mixed together by a mixer, line mixing or the like, the resulting mixture is charged into a settler and the metal compound is then added to the mixture in the settler.

In a case where this invention is effected by a solvent deasphalting system using countercurrent extraction tower, it is preferable that a line for feeding the metal compound is connected to a line for feeding the solvent thereby to form a mixture of the solvent and metal compound, and the resulting mixture is then introduced into the extraction tower at the bottom since this procedure can dispense with wholesale reconstruction of the existing installations for effecting the solvent deasphalting. Further, in a case where this invention is carried out by a forced separation type solvent deasphalting process, it is preferable that either a line for feeding the metal compound is connected to a line for feeding the solvent thereby to form a solvent-metal compound mixture which is then mixed with the hydrocarbons to form a three-component mixture, or the hydrocarbons, metal compound and solvent are mixed together on a mixer to form a three-component mixture, and the three-component mixture is then introduced into a forced separator for separation.

In one embodiment of this invention, the asphaltene-containing hydrocarbons are subjected to primary asphaltene separation by the use of a conventional solvent deasphalting process using a countercurrent extraction tower or forced separator, a deasphalted oil-solvent mixture from these tower or separator is incorporated with the metal compound to separate the asphaltene still remaining in said mixture and the metal compound-incorporated mixture is then introduced into settlers for effecting secondary separation of asphaltene. It is also possible to further add the metal compound at the time of primary separation in accordance with this invention.

The temperature used in the process of the invention varies depending on the kind of a solvent used. The use of too low a temperature will result in deteriorating the fluidity of asphaltene-containing hydrocarbons to be treated and rendering it difficult to handle the asphaltene separated, the use of too high a temperature will result in not only requiring a high pressure to prevent boiling of the solvent but also tending to cause condensation reactions and polymerization reactions. Thus, in general, the temperature used in the present process for a time between the addition of the metal compound (B) and solvent (C) and the separation of the asphaltene is in the range of preferably 0°–250° C., more preferably 20°–200° C. and most preferably 40°–150° C. It is also possible in this invention to promote precipitation of the asphaltene by adding the metal compound and solvent to the asphaltene-containing hydrocarbons and then heating the resulting mixture to within said temperature range. In addition, the lower limit of the pressure used in this invention should be such that the solvent does not boil off; however, it is generally in the range of preferably 0.5–150 $Kg/cm^2$, more preferably atmospheric pressure up to 80 $Kg/cm^2$ and most preferably atmospheric pressure up to 50 $Kg/cm^2$.

The oil-solvent mixture from which the asphaltene has been removed in the countercurrent extraction tower, forced separator or the like, is passed to a solvent recovery unit if necessary. This oil-solvent mixture may be treated in any way to recover the solvent therefrom and conventional solvent recovery units may be used for this recovery purpose. Deasphalted oils obtained by removing the solvent from the oil-solvent mixture may usually be used as a starting oil to be treated in the subsequent step of petroleum refining such as fluidized catalytic cracking, hydrogenolysis, hydrodesulfurization or the like.

On the other hand, it is also possible to recover the solvent which is contained in the asphaltene separated in the countercurrent extraction tower, forced separator or the like, by any optional solvent recovery unit if necessary. The asphaltene so obtained may be mixed with, for example, a heavy oil for use as fuel and may also be used as a blending material for asphalt or as a material for activated carbon and the like.

Figure 2:
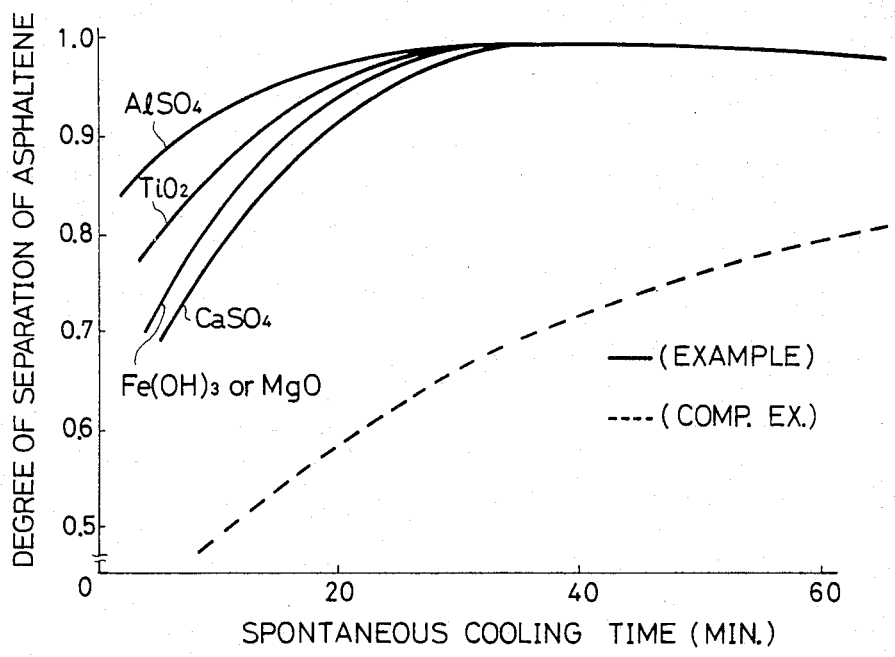
Figure 3:
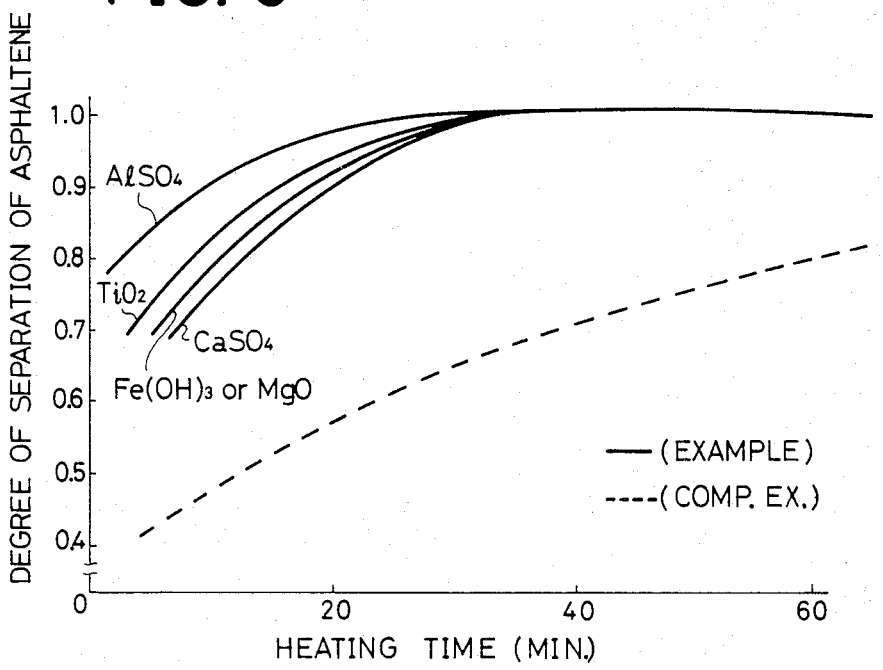

This invention will be better understood by reference to the accompanying drawings in which:

FIG. 1 is a flow sheet of a preferable process for solvent deasphalting asphaltene-containing hydrocarbons in accordance with this invention;

FIG. 2 indicates the relationship between the time for which a mixture according to this invention is allowed to cool and the degree of separation of asphaltene in the case of each of Examples and Comparative Examples in both of which is used the same fixed time for heating the mixture; and FIG. 3 indicates the relationship between the time for heating a mixture according to this invention and the degree of separation of asphaltene in the case of each of Examples and Comparative Examples in both of which is used the same fixed time for allowing the mixture to cool.

Referring now to FIG. 1, asphaltene-containing hydrocarbons to be treated is charged through a line 1 to a mixer A where they are mixed with a metal compound and a solvent supplied to the mixer A respectively through lines 2 and 3 thereby to form a mixture. To promote precipitation of the asphaltene, the thus formed mixture is passed through a line 4 to a heater B by which the mixture is heated to a predetermined temperature selected depending on the kind of the solvent used and under such a pressure that the solvent does not boil at the predetermined temperature, after which the mixture so heated is charged into a settler C. The mixture is allowed to stand still in the settler for a fixed time, preferably for 10 minutes to one hour whereby the asphaltene is precipitated and removed. It is possible at this time to further supply the metal compound through a line 5 in order to accelerate precipitation of the asphaltene. Not only a single settler but also a series of settlers may be used as required. After the asphaltene is removed by precipitation in this manner, the resulting deasphalted oil-solvent mixture present in the upper portion of the settler is passed through a line 6 to a solvent recovery unit D for removing the solvent from the mixture and the deasphalted oil obtained is then recovered through a line 7. On the other hand, the asphaltene precipitated in the lower portion of the settler is recovered through a line 9. In a case where the asphaltene contains a large amount of the solvent, it is passed through a line 10 to a solvent recovery unit E for removing the solvent therefrom and then recovered through a line 11. The solvent recovered at the solvent recovery units D and E is recycled to the mixer A respectively through the line 8 and a line 12 and further through a line 3. At this time a fresh solvent may be supplied through a line 13 as required.

The operational conditions of the process as illustrated in FIG. 1 will depend greatly on the kind of a solvent used. For example, in a case where n-heptane is used as the solvent, the process may be effected at atmospheric pressure and preferably 60°–98° C. by the use of the heater.

This invention will be further better understood by the following non-limitative Examples in comparison with the following Comparative Examples.

EXAMPLE 1 AND COMPARATIVE EXAMPLE 1

An experiment (Example 1) was made as follows.

Thirty (30) grams of a residual oil obtained by distillation of Arabian Light crude oil at a reduced pressure (the properties of the residual oil being as shown in Table 1), were mixed with 100 g of n-heptane and 0.5 g of magnesium sulfate at room temperature (25° C.) and atmospheric pressure to form a mixture which was heated to 99° C. under reflux of the n-heptane for 60 minutes and then allowed to cool (spontaneously cool) thereby to precipitate and remove the asphaltene from the residual oil. The relationship between the spontaneous cooling time after the end of heating and the degree of separation of asphaltene in said experiment was plotted with a solid line as shown in FIG. 2.

For comparison, the procedure of Example 1 was followed except that magnesium oxide was not added. The relationship between the spontaneous cooling time after the end of heating and the degree of separation of asphaltene, was also plotted with a broken line as shown in FIG. 2.

The term "degree of separation of asphaltene" used herein is intended to mean a value represented by the following formula:

$$\text{Degree of separation of asphaltene} = 1 - \frac{\text{Amount}^2 \text{ of asphaltene contained in deasphalted oil}^1 \text{ obtained (wt. \%)}}{\text{Amount}^2 \text{ of asphaltene contained in to-be-deasphalted starting oil (wt. \%)}} \times \text{Yield of deasphalted oil}^3$$

[1]Deasphalted oil was obtained by removing solvent from deasphalted oil-solvent mixture.

[2]Amount of asphaltene contained was measured in accordance with the test method prescribed in IP143.

$$^3\text{Yield of deasphalted oil} = \frac{\text{Weight of deasphalted oil obtained}}{\text{Weight of starting oil to be deasphalted}}$$

TABLE 1

| | | |
|---|---|---|
| Yield of residual oil, based on crude oil (wt. %) | | 25.8 |
| Specific gravity (15/4° C.) | | 1.003 |
| Residual carbon (wt. %) | | 18.16 |
| Ash (wt. %) | | 0.015 |
| Metal content (ppm) | V | 98.2 |
| | Ni | 30.1 |
| H/C ratio (mol) | | 1.40 |
| Analysis of composition (wt. %) | Saturated ingredients | 18.2 |
| | Aromatic ingredients | 52.5 |
| | Resinous ingredients | 23.3 |
| | Asphaltene | 6.0 |

EXAMPLE 2 AND COMPARATIVE EXAMPLE 2

The procedure of Example 1 was followed except that a spontaneous cooling time for the mixture after heating was fixed to be 60 minutes while a heating time for the mixture was varied. The relationship between the heating time and the degree of asphaltene separation was plotted with a solid line as shown in FIG. 3. For comparison, the procedure of Example 2 was followed except that magnesium oxide was not added. Such relationship in this comparative case was plotted by a broken line also as shown in FIG. 3.

EXAMPLES 3–17 AND COMPARATIVE EXAMPLE 3

In each of Examples 3–17, the same residual oil (the properties thereof being as shown in Table 1) as used in Example 1 was mixed with n-heptane in an amount by weight of four times as much as the residual oil at room temperature and atmospheric pressure to form an oil-heptane mixture. The mixtures so formed were further mixed respectively with the various magnesium compounds indicated in Table 2 to form final mixtures which were then heated to 70° C. under agitation for 10 minutes. Soon thereafter, the thus formed final mixtures were each introduced into a separator tube and then treated by a ultracentrifuge to forcibly precipitate and separate the asphaltene from the final mixture. The results are as indicated in Table 2. The operational conditions of the ultracentrifuge used were as follows:

Number of revolutions: 12,000 rpm (18,000 G)

Treating time: 10 minutes

Treating temperature: 20° C.

For comparison, the procedure of Example 3 was followed except that a magnesium compound was not added. The result is also as shown in Table 2.

TABLE 2

| | Magnesium Compounds | Amount of magnesium compound added (wt. % based on starting oil) | Degree of asphaltene separation |
|---|---|---|---|
| Example 3 | Magnesium sulfate | 1.5 | 0.68 |
| 4 | Magnesium sulfite | 2.0 | 0.63 |
| 5 | Magnesium carbonate | 1.8 | 0.66 |
| 6 | Magnesium chloride | 1.8 | 0.67 |
| 7 | Magnesium oxide | 1.2 | 0.72 |
| 8 | Magnesium hydroxide | 1.6 | 0.67 |
| 9 | Magnesium octanoate | 1.4 | 0.63 |
| 10 | Magnesium dodecanoate | 1.8 | 0.62 |
| 11 | Magnesium octadecanoate | 1.5 | 0.62 |
| 12 | Magnesium 4-methyl-3-pentenoate | 2.3 | 0.63 |
| 13 | Magnesium 9-octadecanoate | 1.6 | 0.60 |
| 14 | Magnesium 2-hydroxy-4-methylpentanoate | 2.5 | 0.64 |
| 15 | Magnesium 14-hydroxyhexadecanoate | 2.0 | 0.61 |
| 16 | Magnesium hydroxycarbonate | 1.6 | 0.66 |
| 17 | Potassium magnesium chloride | 2.0 | 0.62 |
| Comp. Example 3 | — | — | 0.19 |

EXAMPLES 18–22

A residual oil (the properties thereof being as shown in Table 3) obtained by distillation of Kafji crude oil at atmospheric pressure was charged into an autoclave provided with an agitator and mixed with each of the solvents indicated in Table 4 at the temperature and pressure indicated in the same Table while simultaneously adding 0.7 wt.%, based on the weight of the residual oil, of magnesium sulfate to the residual oil, to form a mixture which was then agitated at said temperature and pressure for 10 minutes. After the end of the agitation, the thus formed mixture was allowed to stand still for 30 minutes thereby to precipitate and separate the asphaltene from the mixture. The results are as shown in Table 4.

TABLE 3

| | | |
|---|---|---|
| Yield of residual oil (wt. %, based on crude oil) | | 55.2 |
| Specific gravity (15/4° C.) | | 0.9821 |
| Residual carbon (wt. %) | | 13.73 |
| Ash (wt. %) | | 0.027 |
| Metal ingredient | V | 97.3 |
| | Ni | 31.3 |
| H/C ratio (mol) | | 1.50 |
| Analysis of composition (wt. %) | Saturated ingredients | 26.8 |
| | Aromatic ingredients | 48.4 |
| | Resinous ingredients | 11.3 |
| | Asphaltene | 13.5 |

TABLE 4

| | Solvent | Ratio of solvent to starting oil (wt. %) | Operational conditions Temp. (°C.) | Operational conditions Pressure (kg/cm$^2$) | Degree of separation of asphaltene |
|---|---|---|---|---|---|
| Example 18 | n-butane | 4.0 | 90 | 20 | 0.82 |
| 19 | n-pentane | 4.0 | 120 | 25 | 0.80 |
| 20 | n-butanol | 8.0 | 100 | 1 | 0.94 |
| 21 | n-pentane.n-butanol (3:1 wt. ratio) | 6.0 | 80 | 1 | 0.91 |
| 22 | $H_2S$—$CO_2$—propane (1:2:7 vol. ratio) | 6.0 | 50 | 80 | 0.60 |

EXAMPLE 23 AND COMPARATIVE EXAMPLE 4

The same residual oil (the properties thereof being as shown in Table 1) as used in Example 1 was treated by the process illustrated in FIG. 1, thereby to obtain a deasphalted oil.

The residual oil, that is the starting oil, was supplied through the line 1 at a flow rate of 0.5 kg/hr to the mixer A while n-heptane was supplied at a flow rate of 3.0 kg/hr thereto, after which the whole was then thoroughly mixed together at room temperature (25° C.) and atmospheric pressure while magnesium oxide was simultaneously supplied through the line 2 at a rate of 4 g/hr to the mixer A. The resulting mixed liquid was heated to 90° C. by the steam heater B and then passed to the settler C where the asphaltene was precipitated and separated. Then, the deasphalted oil-solvent mixture obtained was passed through the line 6 to the solvent recovery unit D where the solvent was separated from the mixture, thereby obtaining a deasphalted oil at a rate of 0.40 kg/hr through the line 7. The deasphalted oil so obtained had the properties indicated in Table 5. The over-all time needed for completing said process was approximately 30 minutes and the residence time of the oil in the settler was approximately 20 minutes.

For comparison, the procedure of Example 23 was followed except that magnesium oxide was not added through the line 2, thereby to obtain a deasphalted oil at a rate of 0.49 kg/hr through the line 7. The thus obtained deasphalted oil had the properties shown in Table 5.

TABLE 5

| | | Example 23 | Comp. Ex. 4 |
|---|---|---|---|
| Specific gravity (15/4° C.) | | 0.9910 | 1.0014 |
| Residual carbon (wt. %) | | 11.5 | 17.9 |
| Ash (wt. %) | | 0.005 | 0.008 |
| Metal ingredient (ppm) | V | 18 | 68 |
| | Ni | 5 | 21 |
| H/C ratio (mol) | | 1.46 | 1.45 |
| Analysis of composition (wt. %) | Saturated ingredients | 22.6 | 20.2 |
| | Aromatic ingredients | 60.2 | 53.2 |
| | Resinous ingredients | 17.2 | 22.9 |
| | Asphaltene | <0.01 | 3.7 |

As is apparent from the above Example and Comparative Example, in a case where asphaltene-containing hydrocarbons are mixed only with a solvent, it is substantially impossible to separate the asphaltene from the hydrocarbons only by specific gravity precipitation even if the heating time and a spontaneous cooling time is lengthened.

In contrast, the addition of the specific solvent such as n-heptane and a small amount of the specific metal compound such as the magnesium compound in a separation installation in accordance with this invention, will result in rapid precipitation of the asphaltene from an asphaltene-containing oil even if the oil is treated for a short time. The other advantages of this invention are as previously mentioned.

EXAMPLE 24 AND COMPARATIVE EXAMPLE 5

Thirty (30) grams of the same residual oil (the properties thereof being shown in Table 1) were mixed with 100 g of n-heptane and 0.5 g of calcium sulfate at room temperature (25° C.) and atmospheric pressure to form a mixture which was heated to 99° C. under reflux of the n-heptane for 60 minutes and then allowed to cool (spontaneously cool) thereby to precipitate and remove the asphaltene from the residual oil. The relationship between the spontaneous cooling time after the end of heating and the degree of separation of asphaltene in this experiment was plotted with a solid line as shown in FIG. 2.

For comparison, the procedure of Example 24 was followed except that calcium sulfate was not added. The relationship between the spontaneous cooling time after the end of heating and the degree of separation of asphaltene, was also plotted with a broken line (Comparative Example 5) as shown in FIG. 2.

EXAMPLE 25 AND COMPARATIVE EXAMPLE 6

The procedure of Example 24 was followed except that a spontaneous cooling time for the mixture after heating was fixed to be 60 minutes while a heating time for the mixture was varied. The relationship between the heating time and the degree of separation of asphaltene was plotted with a solid line as shown in FIG. 3. For comparison, the procedure of Example 25 was followed except that calcium sulfate was not added, to plot with a broken line the relationship between the heating time and the asphaltene separation degree as shown in FIG. 3.

EXAMPLES 26–42 AND COMPARATIVE EXAMPLE 7

The same residual oil (the properties thereof being as shown in Table 1) as used in Example 1 was mixed with n-heptane in an amount by weight of four times as much as the residual oil at room temperature and atmospheric pressure to form an oil-heptane mixture. The mixtures as formed were further mixed respectively with the various calcium compounds shown in Table 6 to form final mixtures which were then heated to 70° C. under agitation for 10 minutes. Soon thereafter, the thus formed final mixtures were each introduced into a separator tube and then treated by a ultracentrifuge to forcibly precipitate and separate the asphaltene from the final mixture. The results are as indicated in Table 2. The operational conditions of the ultracentrifuge used were identical with those used in Example 3 and were as follows:

Number of revolutions: 12,000 rpm (18,000 G)
Treating time: 10 minutes
Treating temperature: 20° C.

For comparison, the procedure of Example 26 was followed except that the calcium compound was not added. The result is also as shown in Table 6.

TABLE 6

| | Calcium compounds | Amount of calcium compound added (wt. %, based on starting oil) | Degree of separation of asphaltene |
|---|---|---|---|
| Example | | | |
| 26 | Calcium sulfate | 0.8 | 0.71 |
| 27 | Calcium sulfite | 1.0 | 0.63 |
| 28 | Calcium carbonate | 1.3 | 0.68 |
| 29 | Calcium chloride | 1.2 | 0.68 |
| 30 | Calcium oxide | 1.8 | 0.69 |
| 31 | Calcium hydroxide | 2.4 | 0.66 |
| 32 | Calcium octanoate | 1.6 | 0.63 |
| 33 | Calcium dodecanoate | 1.4 | 0.62 |
| 34 | Calcium octadecanoate | 1.8 | 0.61 |
| 35 | Calcium 4-methyl-3-pentenoate | 2.5 | 0.63 |
| 36 | Calcium 9-octadecenoate | 2.0 | 0.60 |
| 37 | Calcium 2-hydroxy-4-methylpentanoate | 1.8 | 0.64 |
| 38 | Calcium 14-hydroxyhexadecanoate | 1.6 | 0.62 |
| 39 | Calcium magnesium carbonate | 2.1 | 0.66 |
| 40 | Bleaching powder | 0.9 | 0.62 |
| 41 | Sodium calcium sulfate | 2.0 | 0.60 |
| 42 | Potassium calcium magnesium sulfate | 1.8 | 0.63 |
| Comp. Ex. 7 | — | — | 0.19 |

EXAMPLES 43–47

A residual oil (the properties thereof being as shown in Table 3) obtained by distillation of Kafji crude oil at atmospheric pressure was charged into an autoclave provided with an agitator and incorporated with each of the solvents indicated in Table 7 at each of the temperatures and pressures in the same Table while simultaneously adding 0.8 wt.%, based on the weight of the residual oil, of calcium carbonate to the residual oil, to form a mixture which was then agitated at said temperature and pressure for 10 minutes. After the end of the agitation, the thus formed mixture was allowed to stand still for 30 minutes thereby to precipitate and separate the asphaltene from the residual oil. The results are as shown in Table 7.

TABLE 7

| | Solvent | Ratio of solvent to starting oil (wt. ratio) | Operational conditions Temp. (°C.) | Pressure (kg/cm²) | Degree of separation of asphaltene |
|---|---|---|---|---|---|
| Example 43 | n-butane | 4.0 | 90 | 20 | 0.83 |
| 44 | n-pentane | 4.0 | 120 | 25 | 0.80 |
| 45 | n-butanol | 8.0 | 100 | 1 | 0.93 |
| 46 | n-pentane. n-butanol (3:1 wt. ratio) | 6.0 | 80 | 1 | 0.90 |
| 47 | $H_2S$—$CO_2$—propane (1:2:7 vol. ratio) | 6.0 | 50 | 80 | 0.61 |

EXAMPLE 48 AND COMPARATIVE EXAMPLE 8

The same residual oil (the properties thereof being as shown in Table 1) as used in Example 1 was treated by the process illustrated in FIG. 1, thereby to obtain a deasphalted oil.

The residual oil, that is the starting oil, was supplied through the line 1 at a flow rate of 0.5 kg/hr to the mixer A while n-heptane was supplied at a flow rate of 3.0 kg/hr thereto, after which the whole was then thoroughly mixed together at room temperature (25° C.) and atmospheric pressure while calcium sulfate was simultaneously supplied through the line 2 at a rate of 4 g/hr to the mixer A. The resulting mixed liquid was heated to 90° C. by the steam heater B and then passed to the settler C where the asphaltene was precipitated and separated. Then, the deasphalted oil-solvent mixuture obtained was passed through the line 6 to the solvent recovery unit D where the solvent was separated from the mixture, thereby obtaining a deasphalted oil at a rate of 0.41 kg/hr through the line 7. The deasphalted oil so obtained had the properties indicated in Table 8. The over-all time needed for completing the process was approximately 30 minutes and the residence time of the oil and additives in the settler was approximately 20 minutes.

For comparison, the procedure of Example 48 was followed except that calcium sulfate was not added through the line 2, thereby to obtain a deasphalted oil at a rate of 0.49 kg/hr through the line 7. The thus obtained deasphalted oil had the properties shown in

TABLE 8

| | | Example 48 | Comp. Ex. 8 |
|---|---|---|---|
| Specific gravity (15/4° C.) | | 0.9911 | 1.0014 |
| Residual carbon (wt. %) | | 11.6 | 17.9 |
| Ash (wt. %) | | 0.005 | 0.008 |
| Metal ingredient (ppm) | V | 18 | 68 |
| | Ni | 5 | 21 |
| H/C ratio (mol) | | 1.46 | 1.45 |
| Analysis of composition (wt. %) | Saturated ingredients | 22.5 | 20.2 |
| | Aromatic ingredients | 60.3 | 53.2 |
| | Resinous ingredients | 17.2 | 22.9 |
| | Asphaltene | <0.01 | 3.7 |

As is apparent from the above Example and Comparative Example, in a case where asphaltene-containing hydrocarbons are incorporated only with a solvent, it is substantially impossible to separate the asphaltene from the hydrocarbons only by specific gravity precipitation even if a heating time and a spontaneous cooling time be lengthened.

In contrast, the addition of the specific solvent and a small amount of the specific metal compound such as the calcium compound in a separation installation in accordance with this invention, will result in rapid precipitation of the asphaltene from an asphaltene-containing oil even if the oil is treated for a short time.

EXAMPLE 49 AND COMPARATIVE EXAMPLE 9

Twenty (20) grams of the same residual oil (the properties thereof being as shown in Table 1) as used in Example 1 were mixed with 100 g of n-heptane and 0.25 g of aluminum sulfate at room temperature (25° C.) and atmospheric pressure to form a mixture which was heated to 99° C. under reflux of the n-heptane for 90 minutes and then allowed to spontaneously cool thereby to precipitate and separate the asphaltene from the residual oil. The relationship between the spontaneous cooling time after the end of heating and the degree of asphaltene separation in the above experiment was plotted with a solid line as shown in FIG. 2.

For comparison, the procedure of Example 49 was followed except that aluminum sulfate was not added and such a relationship in this comparative case was also plotted with a broken line as shown in FIG. 2.

EXAMPLE 50 AND COMPARATIVE EXAMPLE 10

The procedure of Example 49 was followed except that a spontaneous cooling time for the mixture after heating was fixed to be 60 minutes while a heating time for the mixture was varied. The relationship between the heating time and the degree of separation of asphaltene was plotted with a solid line as shown in FIG. 3. For comparison, the procedure of Example 50 was followed except that aluminum sulfate was not added, to plot with a broken line the relationship between the heating time and the asphaltene separation degree as shown in FIG. 3.

EXAMPLES 51-63 AND COMPARATIVE EXAMPLE 11

The same residual oil (the properties thereof being as shown in Table 1) as used in Example 1 was mixed with n-heptane in an amount by weight of four times as much as the residual oil at room temperature and atmospheric pressure to form an oil-heptane mixture. The mixtures so formed were further mixed respectively with the various aluminum compounds shown in Table 9 to form final mixtures which were then heated to 80° C. under agitation for 5 minutes. Soon thereafter, the thus formed final mixtures were each introduced into a separator tube and then treated by a ultracentrifuge to forcibly precipitate and separate the asphaltene from the final mixture. The results are as indicated in Table 9. In addition, the operational conditions of the ultracentrifuge were as those in Example 3.

For comparison, the procedure of Example 51 was followed except that an aluminum compound was not added. The result is also as shown in Table 9.

TABLE 9

| | Aluminum compounds | Amount of aluminum compound added (wt. % based on starting oil) | Degree of separation of asphaltene |
|---|---|---|---|
| Example | | | |
| 51 | Aluminum sulfate | 0.40 | 0.83 |
| 52 | Potassium alum | 0.50 | 0.67 |
| 53 | Ammonium alum | 0.50 | 0.64 |
| 54 | Aluminum chloride | 0.60 | 0.80 |
| 55 | Polyaluminum chloride | 0.40 | 0.72 |
| 56 | Aluminum oxide | 0.60 | 0.77 |
| 57 | Aluminum hydroxide | 0.80 | 0.66 |
| 58 | Basic aluminum sulfate | 0.60 | 0.75 |
| 59 | Sodium aluminate | 0.45 | 0.73 |
| 60 | Calcium aluminate | 0.45 | 0.65 |
| 61 | Aluminum hexanoate | 0.50 | 0.62 |
| 62 | Aluminum stearate | 0.50 | 0.58 |
| 63 | Alumina gel | 0.60 | 0.76 |
| Comp. Ex. 11 | — | — | 0.19 |

EXAMPLES 64–68

A residual oil (the properties thereof being as shown in Table 3) obtained by distillation of Kafji crude oil at atmospheric pressure was charged into an autoclave provided with an agitator and mixed with each of the solvents indicated in Table 10 at the temperature and pressure indicated in the same Table while simultaneously adding 0.6 wt.%, based on the weight of the residual oil, of aluminum sulfate to the residual oil, to form a mixture which was then agitated at said temperature and pressure for 5 minutes. After the end of the agitation, the thus formed mixture was allowed to stand still for 60 minutes thereby to precipitate and separate the asphaltene from the residual oil. The results are as shown in Table 10.

TABLE 10

| | Solvent | Ratio of solvent to starting oil (wt. ratio) | Operational conditions Temp. (°C.) | Pressure (kg/cm²) | Degree of separation of asphaltene |
|---|---|---|---|---|---|
| Example 64 | n-butane | 5.0 | 90 | 20 | 0.88 |
| 65 | n-pentane | 5.0 | 120 | 25 | 0.85 |
| 66 | n-butanol | 8.0 | 100 | 1 | 0.98 |
| 67 | n-pentane. n-butanol (3:1 wt. ratio) | 6.0 | 80 | 1 | 0.95 |
| 68 | $H_2S$—$CO_2$—propane (1:2:7 vol. ratio) | 6.0 | 50 | 75 | 0.65 |

EXAMPLE 69 AND COMPARATIVE EXAMPLE 12

The same residual oil (the properties thereof being as shown in Table 1) as used in Example 1 was treated by the process illustrated in FIG. 1, thereby to obtain a deasphalted oil.

The residual oil, that is the starting oil, was supplied through the line 1 at a flow rate of 0.5 kg/hr to the mixer A while n-haptane was supplied at a flow rate of 4.0 kg/hr thereto, after which the whole was then thoroughly mixed together at room temperature (25° C.) and atmospheric pressure while aluminum sulfate was simultaneously supplied through the line 2 at a rate of 2 g/hr to the mixer A. The resulting mixed liquid was heated to 80° C. by the steam heater B and the passed to the settler C where the asphaltene was precipitated and separated. Then, the deasphalted oil-solvent mixture obtained was passed through the line 6 to the solvent recovery unit D where the solvent was separated from the mixture, thereby obtaining a deasphalted oil at a rate of 0.43 kg/hr through the line 7. The deasphalted oil so obtained had the properties indicated in Table 11. The over-all time needed for completing said process was approximately 30 minutes and the residence time of the oil in the settler was approximately 20 minutes.

For comparison, the procedure of Example 69 was followed except that aluminum sulfate was not added through the line 2, thereby to obtain a deasphalted oil at a rate of 0.49 kg/hr through the line 7. The thus obtained deasphalted oil had the properties shown in Table 11.

TABLE 11

| | | Example 69 | Comp. Ex. 12 |
|---|---|---|---|
| Specific gravity (15/4° C.) | | 0.9900 | 1.0014 |
| Residual carbon (wt. %) | | 11.2 | 17.9 |
| Ash (wt. %) | | 0.004 | 0.008 |
| Metal ingredient (ppm) | V | 16 | 68 |
| | Ni | 4 | 21 |
| H/C ratio (mol) | | 1.48 | 1.45 |
| Analysis of composition (wt. %) | Saturated ingredients | 23.3 | 20.2 |
| | Aromatic ingredients | 59.7 | 53.2 |
| | Resinous ingredients | 17.0 | 22.9 |
| | Asphaltene | <0.01 | 3.7 |

As is apparent from the above Example and Comparative Example, in a case where asphaltene-containing hydrocarbons are mixed only with a solvent, it is substantially impossible to separate the asphaltene from the hydrocarbons only by specific gravity precipitation even if a heating time and a spontaneous cooling time is lengthened. Accordingly, it is essential for an existing separation installation to include therein special units such as a countercurrent extraction tower and a forced separator in order to separate asphaltene unless this invention is practiced by said separation installation.

In contrast, the addition of the specific solvent such as n-heptane and a small amount of the specific metal compound such as the aluminum compound in a separation installation in accordance with this invention, will result in rapid precipitation of the asphaltene from an asphaltene-containing oil even if the oil is treated for a short time. It will therefore be possible to separate asphaltene with satisfactory selectivity by the use of a simplified separation installation without such special units if this invention is used for asphaltene separation purposes.

EXAMPLE 70 AND COMPARATIVE EXAMPLE 13

Thirty (30) grams of the same residual oil (the properties thereof being as shown in Table 1), were mixed with 100 g of n-heptane and 0.5 g of iron (III) hydroxide at room temperature (25° C.) and atmospheric pressure to form a mixture which was heated to 99° C. under reflux of the n-heptane for 60 minutes and then allowed to cool (spontaneously cool) thereby to precipitate and separate the asphaltene from the residual oil. The relationship between the spontaneous cooling time after the end of heating and the degree of separation of asphaltene in this experiment was plotted with a solid line as shown in FIG. 2.

For comparison, the procedure of Example 70 was followed except that iron (III) hydroxide was not added. The relationship between the spontaneous cooling time after the end of heating and the degree of separation of asphaltene, was also plotted with a broken line as shown in FIG. 2.

EXAMPLE 71 AND COMPARATIVE EXAMPLE 14

The procedure of Example 70 was followed except that a spontaneous cooling time for the mixture after heating was fixed to be 60 minutes while a heating time for the mixture was varied. The relationship between the heating time and the degree of separation of asphaltene was plotted with a solid line as shown in FIG. 3. For comparison, the procedure of Example 71 was followed except that iron (III) hydroxide was not added, to plot with a broken line the relationship between the heating time and the asphaltene separation degree as shown in FIG. 3.

EXAMPLES 72–86 AND COMPARATIVE EXAMPLE 15

The same residual oil (the properties thereof being as shown in Table 1) as used in Example 1 was mixed with n-heptane in an amount by weight of four times as much as the residual oil at room temperature and atmospheric pressure to form an oil-heptane mixture. The mixture as formed were further mixed respectively with the various iron compounds shown in Table 12 to form final mixtures which were then heated to 70° C. under agitation for 10 minutes. Soon thereafter, the thus formed final mixtures were each introduced into a separator tube and then treated by a ultracentrifuge to forcibly precipitate and separate the asphaltene from the final mixture. The results are as indicated in Table 2. The operational conditions of the ultracentrifuge used were the same as those in Example 3. For comparison, the procedure of Example 72 was followed except that an iron compound was not added. The result is also as shown in Table 12.

TABLE 12

| | Iron Compounds | Amount of iron compound added (wt. %, based on starting oil) | Degree of separation of asphaltene |
|---|---|---|---|
| Example | | | |
| 72 | Iron (III) sulfate | 1.6 | 0.70 |
| 73 | Iron (III) hydroxysulfate | 2.1 | 0.65 |
| 74 | Iron (II) sulfite | 2.7 | 0.66 |
| 75 | Iron (II) carbonate | 2.4 | 0.66 |
| 76 | Iron (II) chloride | 1.7 | 0.66 |
| 77 | Iron (III) chloride | 1.6 | 0.64 |
| 78 | Iron (III) oxychloride | 2.0 | 0.65 |
| 79 | Iron (II) oxide | 0.9 | 0.71 |
| 80 | Iron (III) oxide | 1.8 | 0.69 |
| 81 | Iron (II) hydroxide | 2.2 | 0.66 |
| 82 | Iron (III) hydroxide | 1.1 | 0.74 |
| 83 | Ferrosoferric hydroxide | 0.8 | 0.64 |
| 84 | Magnesium ferrite | 1.8 | 0.70 |
| 85 | Potassium iron (III) sulfate | 2.6 | 0.61 |
| 86 | Sodium ferrite | 2.5 | 0.60 |
| Comp. Ex. 15 | — | — | 0.19 |

EXAMPLES 87–91

A residual oil (the properties thereof being as shown in Table 3) obtained by distillation of Kafji crude oil at atmospheric pressure was charged into an autoclave provided with an agitator and incorporated with each of the solvents indicated in Table 13 at each of the temperatures and pressures in the same Table while simultaneously adding 0.8 wt.%, based on the weight of the residual oil, of iron (III) sulfate to the residual oil, to form a mixture which was then agitated at said temperature and pressure for 10 minutes. After the end of the agitation, the thus formed mixture was allowed to stand still for 30 minutes thereby to precipitate and separate the asphaltene from the residual oil. The results are as shown in Table 13.

TABLE 13

| | Solvent | Ratio of solvent to starting oil (wt. ratio) | Operational conditions Temp. (°C.) | Operational conditions Pressure (kg/cm$^2$) | Degree of separation of asphaltene |
|---|---|---|---|---|---|
| Example 87 | n-butane | 4.0 | 90 | 20 | 0.82 |
| 88 | n-pentane | 4.0 | 120 | 25 | 0.80 |
| 89 | n-butanol | 8.0 | 100 | 1 | 0.94 |
| 90 | n-pentane. n-butanol (3:1 wt. ratio) | 6.0 | 80 | 1 | 0.91 |

TABLE 13-continued

| Solvent | Ratio of solvent to starting oil (wt. ratio) | Operational conditions Temp. (°C.) | Pressure (kg/cm²) | Degree of separation of asphaltene |
|---|---|---|---|---|
| 91 $H_2S$—$CO_2$—propane (1:2:7 vol. ratio) | 6.0 | 50 | 80 | 0.60 |

EXAMPLE 92 AND COMPARATIVE EXAMPLE 16

The same residual oil (the properties thereof being shown in Table 1) as used in Example 1 was treated by the process illustrated in FIG. 1, thereby to obtain a deasphalted oil.

The residual oil, that is the starting oil, was supplied through the line 1 at a flow rate of 0.5 kg/hr to the mixer A while n-heptane was supplied at a flow rate of 3.0 kg/hr thereto, after which the whole was then thoroughly mixed together at room temperature (25° C.) and atmospheric pressure while iron (II) oxide was simultaneously supplied through the line 2 at a rate of 4 g/hr to the mixer A. The resulting mixed liquid was heated to 90° C. by the steam heater B and then passed to the settler C where the asphaltene was precipitated and separated. Then, the deasphalted oil-solvent mixture obtained was passed through the line 6 to the solvent recovery unit D where the solvent was separated from the mixture, thereby obtaining a deasphalted oil at a rate of 0.41 kg/hr through the line 7. The deasphalted oil so obtained had the properties indicated in Table 14. The over-all time needed for completing said process was approximately 30 minutes and the residence time of the oil in the settler was approximately 20 minutes.

For comparison, the procedure of Example 92 was followed except that iron (II) oxide was not added through the line 2, thereby to obtain a deasphalted oil at a rate of 0.49 kg/hr through the line 7. The thus obtained deasphalted oil had the properties shown in Table 14.

TABLE 14

| | | Example 92 | Comp. Ex. 16 |
|---|---|---|---|
| Specific gravity (15/4° C.) | | 0.9908 | 1.0014 |
| Residual carbon (wt. %) | | 11.4 | 17.9 |
| Ash (wt. %) | | 0.004 | 0.008 |
| Metal ingredient (ppm) | V | 17 | 68 |
| | Ni | 5 | 21 |
| H/C ratio (mol) | | 1.40 | 1.45 |
| Analysis of composition (wt. %) | Saturated ingredients | 22.7 | 20.2 |
| | Aromatic ingredients | 59.9 | 53.2 |
| | Resinous ingredients | 17.4 | 22.9 |
| | Asphaltene | <0.01 | 3.7 |

As is apparent from the above Example and Comparative Example, in a case where asphaltene-containing hydrocarbons are incorporated only with a solvent, it is substantially impossible to separate the asphaltene from the hydrocarbons only by specific gravity precipitation even if a heating time and a spontaneous cooling time be lengthened.

In contrast, the addition of the specific solvent and a small amount of the specific metal compound such as the iron compound in a separation installation in accordance with this invention, will result in rapid precipitation of the asphaltene from an asphaltene-containing oil even if the oil is treated for a short time.

EXAMPLE 93 AND COMPARATIVE EXAMPLE 17

Thirty (30 grams of the same residual oil (the properties being as shown in Table 1) were mixed with 100 g of n-heptane and 0.2 g of titanium (IV) oxide at room temperature (25° C.) and atmospheric pressure to form a mixture which was heated to 99° C. under reflux of the n-heptane for 60 minutes and then allowed to cool (spontaneously cool) thereby to precipitate and separate the asphaltene from the residual oil. The relationship between the spontaneous cooling time after the end of heating and the degree of separation of asphaltene in this experiment was plotted with a solid line as shown in FIG. 2.

For comparison, the procedure of Example 93 was followed except that titanium (IV) oxide was not added. The relationship between the spontaneous cooling time after the end of heating and the degree of separation of asphaltene, was also plotted with a broken line as shown in FIG. 2.

EXAMPLE 94 AND COMPARATIVE EXAMPLE 18

The procedure of Example 93 was followed except that a spontaneous cooling time for the mixture after heating was fixed to be 60 minutes while the heating time for the mixture was varied. The relationship between the heating time and the degree of separation of asphaltene was plotted with a solid line as shown in FIG. 3. For comparison, the procedure of Example 2 was followed except that titanium (IV) oxide was not added, to plot with a broken line the relationship between the heating time and the asphaltene separation degree as shown in FIG. 3.

EXAMPLES 95-113 AND COMPARATIVE EXAMPLE 19

The same residual oil (the properties thereof being as shown in Table 1) as used in Example 1 was mixed with n-heptane in an amount by weight of four times as much as the residual oil at room temperature and atmospheric pressure to form an oil-heptane mixture. The mixtures so formed were further mixed respectively with the various titanium compounds shown in Table 15 to form final mixtures which were then heated to 70° C. under agitation for 10 minutes. Soon thereafter, the thus formed final mixtures were each introduced into a separator tube and then treated by a ultracentrifuge to forcibly precipitate and separate the asphaltene from the final mixture. The results are as indicated in Table 15. The operational conditions of the ultracentrifuge used were the same as those in Example 3. For comparison, the procedure of Example 95 was followed except that titanium compound was not added. The result is also as shown in Table 15.

TABLE 15

| | Titanium compounds | Amount of titanium compound added (wt. %, based on) starting oil) | Degree of separation of asphaltene |
|---|---|---|---|
| Example | | | |
| 95 | Titanium (III) sulfate | 2.0 | 0.63 |
| 96 | Titanium (IV) sulfate | 1.4 | 0.72 |
| 97 | Titanium oxysulfate | 1.6 | 0.62 |
| 98 | Titanium oxytrisulfate | 2.5 | 0.61 |
| 99 | Titanium (III) chloride | 3.0 | 0.60 |
| 100 | Titanium (II) oxide | 2.0 | 0.62 |
| 101 | Titanium (III) oxide | 2.3 | 0.66 |
| 102 | Titanium (IV) oxide | 0.8 | 0.78 |
| 103 | Titanium (III) hydroxide | 2.3 | 0.65 |
| 104 | Titanium (IV) hydroxide | 2.5 | 0.66 |
| 105 | Calcium titanium sulfate | 2.2 | 0.70 |
| 106 | Magnesium metatitanate | 1.8 | 0.72 |
| 107 | Calcium metatitanate | 1.7 | 0.68 |
| 108 | Iron (II) metatitanate | 1.3 | 0.74 |
| 109 | Iron (II) orthotitanate | 1.7 | 0.72 |
| 110 | Iron (III) titanium oxide | 1.2 | 0.72 |
| 111 | Potassium titanium sulfate | 2.1 | 0.58 |
| 112 | Sodium metatitanate | 2.7 | 0.60 |
| 113 | Barium metatitanate | 2.6 | 0.61 |
| Comp. Ex. 19 | — | — | 0.19 |

EXAMPLES 114–118

A residual oil (the properties thereof being as shown in Table 3) obtained by distillation of Kafji crude oil at atmospheric pressure was charged into an autoclave provided with an agitator and incorporated with each of the solvents indicated in Table 16 at each of the temperatures and pressures in the same Table while simultaneously adding 0.8 wt.%, based on the weight of the residual oil, of titanium(IV) sulfate to the residual oil, to form a mixture which was then agitated at said temperature and pressure for 10 minutes. After the end of the agitation, the thus formed mixture was allowed to stand still for 30 minutes thereby to precipitate and separate the asphaltene from the residual oil. The results are as shown in Table 16.

TABLE 16

| | Solvent | Ratio of solvent to starting oil (wt. ratio) | Operational conditions Temp. (°C.) | Pressure (kg/cm$^2$) | Degree of separation of asphaltene |
|---|---|---|---|---|---|
| Example 114 | n-butane | 4.0 | 90 | 20 | 0.86 |
| 115 | n-pentane | 4.0 | 120 | 25 | 0.82 |
| 116 | n-butanol | 8.0 | 100 | 1 | 0.96 |
| 117 | n-pentane. n-butanol (3:1 wt. ratio) | 6.0 | 80 | 1 | 0.93 |
| 118 | $H_2S$—$CO_2$—propane (1:2:7 vol. ratio) | 6.0 | 50 | 80 | 0.64 |

EXAMPLE 119 AND COMPARATIVE EXAMPLE 20

The same residual oil (the properties thereof being as shown in Table 1) as used in Example 1 was treated by the process illustrated in FIG. 1, thereby to obtain a deasphalted oil.

The residual oil, that is the starting oil, was supplied through the line 1 at a flow rate of 0.5 kg/hr to the mixer A while n-heptane was supplied at a flow rate of 3.0 kg/hr thereto, after which the whole was then thoroughly mixed together at room temperature (25° C.) and atmospheric pressure while titanium(IV) oxide was simultaneously supplied through the line 2 at a rate of 3 g/hr to the mixer A. The resulting mixed liquid was heated to 90° C. by the steam heater B and then passed to the settler C where the asphaltene was precipitated and separated. Then, the deasphalted oil-solvent mixture obtained was passed through the line 6 to the solvent recovery unit D where the solvent was separated from the mixture, thereby obtaining a deasphalted oil at a rate of 0.41 kg/hr through the line 7. The deasphalted oil so obtained had the properties indicated in Table 17. The over-all time needed for completing said process was approximately 30 minutes and the residence time of the oil in the settler was approximately 20 minutes.

For comparison, the procedure of Example 119 was followed except that titanium(IV) oxide was not added through the line 2, thereby to obtain a deasphalted oil at a rate of 0.49 kg/hr through the line 7. The thus obtained deasphalted oil had the properties shown in Table 17.

TABLE 17

| | | Example 119 | Comp. Ex. 20 |
|---|---|---|---|
| Specific gravity (15/4° C.) | | 0.9906 | 1.0014 |
| Residual carbon (wt. %) | | 11.3 | 17.9 |
| Ash (wt. %) | | 0.004 | 0.008 |
| Metal ingredient (ppm) | V | 15 | 68 |
| | Ni | 3 | 21 |
| H/C ratio (mol) | | 1.47 | 1.45 |
| Analysis of composition (wt. %) | Saturated ingredients | 23.2 | 20.2 |
| | Aromatic ingredients | 60.1 | 53.2 |
| | Resinous ingredients | 16.7 | 22.9 |
| | Asphaltene | <0.01 | 3.7 |

As is clear from the above Example and Comparative Example, in a case where asphaltene-containing hydrocarbons are mixed only with a solvent, it is substantially impossible to separate the asphaltene from the hydrocarbons only by specific gravity precipitation even if a heating time and a spontaneous cooling time be lengthened.

In contrast, the addition of the specific solvent and a small amount of the specific metal compound such as the titanium compound in a separation installation in accordance with this invention, will result in rapid precipitation of the asphaltene from an asphaltene-containing oil even if the oil is treated for a short time.

EXAMPLES 120–121 AND COMPARATIVE EXAMPLE 21

The same residual oil (the properties thereof being as shown in Table 1) as used in Example 1 was treated by the process illustrated in FIG. 1, thereby to obtain a deasphalted oil.

More particularly, the residual oil, that is the starting oil, was supplied through the line 1 at a flow rate of 0.5 kg/hr to the mixer A while n-pentane was supplied through the line 3 at a flow rate of 2.0 kg/cm$^2$ thereto, after which the whole was thoroughly mixed together at 120° C. and 15 kg/cm$^2$ simultaneously with supplying through the line 2 aluminum sulfate at a rate of 3 g/hr (in Example 120) or titanium (IV) oxide (in Example 121) at a rate of 2 g/hr to the mixer A. Each of the resulting liquid mixtures was heated by the heater B and then charged at 150° C. and 15 kg/cm$^2$ into the settler C where the asphaltene was precipitated from the residual oil. Thereafter, the deasphalted oil-solvent mixture obtained was passed through the line 6 to the solvent recovery unit D where the solvent was separated from the mixture, thereby obtaining a deasphalted oil at a rate of 0.40 kg/hr through the line 7. The thus obtained deasphalted oil had the properties indicated in Table 18. The over-all time needed for completing said process was approximately 50 minutes and the residence time of the oil in the settler was approximately 35 minutes.

For comparison, the procedure of Example 120 was followed except that such a metal compound as above was not supplied through the line 2, thereby to obtain a deasphalted oil at a rate of 0.40 kg/hr through the line 7. The deasphalted oil so obtained had the properties shown in Table 18.

TABLE 18

| | | Example 120 | Example 121 | Comp. Ex. 21 |
|---|---|---|---|---|
| Specific gravity (15/4° C.) | | 0.9850 | 0.9870 | 0.9980 |
| Residual carbon (wt. %) | | 8.70 | 8.90 | 13.0 |
| Ash (wt. %) | | 0.003 | 0.004 | 0.007 |
| Metal ingredient (ppm) | V | 9 | 10 | 25 |
| | Ni | 2 | 3 | 8 |
| H/C ratio (mol) | | 1.52 | 1.50 | 1.46 |
| Analysis of composition (wt. %) | Saturated ingredients | 30.2 | 29.5 | 21.8 |
| | Aromatic ingredients | 61.3 | 61.2 | 58.9 |
| | Resinous ingredients | 8.5 | 9.3 | 18.8 |
| | Asphaltene | 0 | 0 | 0.5 |

As is apparent from the foregoing Examples and Comparative Examples, in a case where asphaltene-containing hydrocarbons are mixed only with a solvent, it is substantially impossible to separate the asphaltene from the hydrocarbons only by specific gravity precipitation even if a heating time and a spontaneous cooling time be lengthened. Accordingly, it is essential for an existing separation installation to include therein special units such as a countercurrent extraction tower and a forced separator in order to separate asphaltene unless this invention is practiced by said separation installation.

In contrast, the addition of at least one of the specific solvents according to this invention and a small amount of at least one of the specific metal compounds according to this invention in a separation installation in accordance with this invention, will result in rapid precipitation of the asphaltene from an asphaltene-containing oil even if the oil is treated for a short time. It will therefore be possible to separate asphaltene with satisfactory selectivity by the use of a simplified separation installation without such special units if this invention is used for asphaltene separation purposes.

What is claimed is:

1. A process for the solvent deasphalting of asphaltene-containing hydrocarbon which comprises (I) mixing (A) 100 parts by weight of asphaltene-containing hydrocarbon with (B) 0.05–10 parts by weight per 100 parts by weight of said asphaltene-containing hydrocarbon of aluminum sulfate (C) 50–2,000 parts by weight per 100 parts by weight of said asphaltene-containing hydrocarbon of at least one solvent selected from the group consisting of (1) aliphatic and alicyclic hydrocarbons having 3–30 carbon atoms, (2) saturated aliphatic and saturated alicyclic monohydric alcohols, (3) liquid hydrogen sulfide, and (4) liquid carbon dioxide to form a mixture of the materials (A), (B) and (C) and then (II) allowing the thus formed mixture to stand still to precipitate and separate the asphaltene therefrom thereby obtaining a deasphalted oil, wherein the step of mixing, precipitation and separation of the asphaltene are effected at a temperature of 20°–200° C. and a pressure of 0.5–150 kg/cm$^2$ with the proviso that the lower limit of the pressure is such that the solvent used does not evaporate at the temperature used.

2. A process according to claim 1, wherein the solvent selected from the group consisting of propane, n-butene, n-pentene, n-hexane, n-heptane, n-propanol, n-isopropanol, n-butanol and a mixed solvent containing (1) a hydrocarbon selected from the group consisting of propane, n-butane and n-pentane and (2) an alcohol selected from the group consisting of n-propanol, isopropanol and n-butanol.

3. A process according to claim 1, wherein the asphaltene-containing hydrocarbon is selected from the group consisting of a residual oil obtained by atmospheric pressure distillation of a crude oil, a residual oil obtained by reduced pressure distillation and a residual oil obtained by cracking petroleum.

4. The process according to claim 1 wherein the steps of mixing precipitation and separation of the asphaltene are effected at a temperature of 40°–150° C. and at a pressure of up to 50 kg/cm$^2$.

5. The process according to claim 1 wherein said asphaltene-containing hydrocarbon is a residual oil obtained by distillation of Arabian Light crude oil, the solvent is n-heptane and the mixture is heated to 99° C.

6. The process according to claim 1 wherein said asphaltene-containing hydrocarbon is a residual oil obtained by distillation of Kafji crude oil, the solvent is a n-butane, n-pentane, n-butanol, a mixture of n-pentane and n-butanol or $H_2S$-$CO_2$-propane and the mixture is heated at a temperature between 50°–120° C.

7. The process according to claim 1 wherein the said asphaltene-containing hydrocarbon is a residual oil obtained by the distillation of Arabian Light crude oil, the solvent is n-heptane and the mixture is heated up to 80° C.

* * * * *